US009829013B2

(12) United States Patent
Cho et al.

(10) Patent No.: US 9,829,013 B2
(45) Date of Patent: Nov. 28, 2017

(54) HYDRAULIC SYSTEM FOR CONSTRUCTION MACHINE

(71) Applicant: DOOSAN INFRACORE CO., LTD., Incheon (KR)

(72) Inventors: Yong Lak Cho, Incheon (KR); Dal Sik Jang, Seoul (KR); Woo Yong Jung, Seoul (KR); Min Ha An, Seoul (KR); A Reum Seo, Incheon (KR); Sang Woo Lee, Gimpo-si (KR); Yoon Seok Jang, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 17 days.

(21) Appl. No.: 14/776,367

(22) PCT Filed: Mar. 13, 2014

(86) PCT No.: PCT/KR2014/002089

§ 371 (c)(1),
(2) Date: Sep. 14, 2015

(87) PCT Pub. No.: WO2014/142562

PCT Pub. Date: Sep. 18, 2014

(65) Prior Publication Data

US 2016/0032945 A1 Feb. 4, 2016

(30) Foreign Application Priority Data

Mar. 14, 2013 (KR) ..... 10-2013-0027260
Feb. 25, 2014 (KR) ..... 10-2014-0021798

(51) Int. Cl.
*F15B 1/02* (2006.01)
*F15B 1/027* (2006.01)
(Continued)

(52) U.S. Cl.
CPC ..... *F15B 1/027* (2013.01); *E02F 9/2217* (2013.01); *E02F 9/2267* (2013.01);
(Continued)

(58) Field of Classification Search
CPC .. F15B 1/04; F15B 11/10; F15B 11/17; F15B 13/04; F15B 13/027; F15B 1/027; E02F 9/2289; E02F 9/2217
(Continued)

(56) References Cited

U.S. PATENT DOCUMENTS 5,329,767 A 7/1994 Hewett
2011/0030364 A1* 2/2011 Persson ..... E02F 9/2217 60/428
(Continued)

FOREIGN PATENT DOCUMENTS

JP 58-193901 A 11/1983
JP 2002327714 A 11/2002
(Continued)

OTHER PUBLICATIONS

Chinese Office Action for corresponding Chinese Patent Application No. 201480014846.9 dated Jul. 29, 2016.
European Search Report for corresponding European Patent Application No. 14764931.3 dated Sep. 20, 2016.
International Search Report for PCT/KR2014/002089 dated Jun. 19, 2014.

*Primary Examiner* — Thomas E Lazo
(74) *Attorney, Agent, or Firm* — Hauptman Ham, LLP

(57) ABSTRACT

The present disclosure relates to a hydraulic system for a construction machine, and more particularly, to a hydraulic system for a construction machine including a plurality of actuators, in which each of the actuators includes a pump/motor, is operated under a control of a corresponding pump/motor, and stores working oil in an accumulator or receives the working oil supplemented from the accumulator in accordance with a difference between a flow rate entering the actuator and a flow rate discharged from the actuator.

9 Claims, 14 Drawing Sheets

(51) Int. Cl.

| | |
|---|---|
| ***E02F 9/22*** | (2006.01) |
| ***F15B 11/17*** | (2006.01) |
| ***F15B 1/04*** | (2006.01) |
| ***F15B 11/10*** | (2006.01) |
| ***F15B 13/02*** | (2006.01) |
| ***F15B 13/04*** | (2006.01) |

(52) U.S. Cl.
CPC ..... *E02F 9/2289* (2013.01); *E02F 9/2292* (2013.01); *E02F 9/2296* (2013.01); *F15B 1/04* (2013.01); *F15B 11/10* (2013.01); *F15B 11/17* (2013.01); *F15B 13/027* (2013.01); *F15B 13/04* (2013.01); *F15B 2201/4155* (2013.01); *F15B 2201/51* (2013.01); *F15B 2211/20561* (2013.01); *F15B 2211/20576* (2013.01); *F15B 2211/212* (2013.01); *F15B 2211/27* (2013.01); *F15B 2211/40* (2013.01); *F15B 2211/7053* (2013.01); *F15B 2211/785* (2013.01)

(58) Field of Classification Search
USPC ..... 60/413
See application file for complete search history.

(56) References Cited

U.S. PATENT DOCUMENTS

| | | | | |
|---|---|---|---|---|
| 2012/0324875 | A1* | 12/2012 | Edler | E02F 9/123 60/327 |
| 2013/0047599 | A1 | 2/2013 | Opdenbosch et al. | |
| 2013/0048117 | A1* | 2/2013 | Opdenbosch | E02F 9/2217 137/565.01 |
| 2014/0350731 | A1* | 11/2014 | Kim | F15B 19/002 700/275 |

FOREIGN PATENT DOCUMENTS

| | | | |
|---|---|---|---|
| JP | 2008309297 | A | 12/2008 |
| KR | 1019990082097 | A | 11/1999 |
| KR | 101121705 | B1 | 3/2012 |
| KR | 101155785 | B1 | 6/2012 |

* cited by examiner

HYDRAULIC SYSTEM FOR CONSTRUCTION MACHINE

FIELD OF THE DISCLOSURE

The present disclosure relates to a hydraulic system for a construction machine, and more particularly, to a hydraulic system for a construction machine including a plurality of actuators, in which each of the actuators includes a pump/motor, is operated under a control of a corresponding pump/motor, and stores working oil in an accumulator or receives the working oil supplemented from the accumulator in accordance with a difference between a flow rate entering the actuator and a flow rate discharged from the actuator.

Further, the present disclosure relates to a hydraulic system for a construction machine, which supplements a flow rate when a flow rate is insufficient in a hydraulic pressure line, and discharges a flow rate when the flow rate in the hydraulic pressure line is excessive.

BACKGROUND OF THE DISCLOSURE

In general, a hydraulic system for a construction machine includes an engine generating power, a main hydraulic pump driven by receiving the power of the engine to discharge working oil, a plurality of actuators performing an operation, an operating unit operated so as to operate an actuator of a desired operating device, and a main control valve distributing working oil required by the operation of the operating unit to a corresponding actuator.

The operating unit forms a required value (flow rate) according to a displacement of an operation of an operator, and a flow rate of working oil discharged from the hydraulic pump is controlled by the required value. The operating unit includes, for example, a joystick and a pedal. As described above, the control of a flow rate of working oil is referred to as a flow rate control of the hydraulic system.

Further, in order to discharge working oil from the main hydraulic pump, rotation torque of the pump needs to be changed. The torque is referred to as pump torque. The pump torque T is calculated by multiplying a pump capacity by pressure P formed in working oil. The pump capacity is a flow rate of working oil discharged for one rotation of a shaft of the pump.

The capacity of the hydraulic pump may be varied by an inclination angle of a swash plate and revolutions per minute (rpm) of the engine. When an inclination angle of the swash plate is small, a capacity is small, and when an inclination angle of the swash plate is large, a capacity is large.

An inclination angle of the swash plate is controlled by a pump controller of a corresponding hydraulic pump. Further, when the rpm of the engine is large, a flow rate is increased, and when the rpm of the engine is small, a flow rate is decreased.

In order to rapidly operate the actuator in a state where a working load is not applied to the actuator, the hydraulic pump is controlled by the pump controller so that a flow rate is increased. By contrast, in a state where a large working load is applied to the actuator, in order to meet limited torque of the engine, the hydraulic pump is controlled by the pump controller so that a flow rate is decreased. The control of the pump torque implemented by the hydraulic pump is referred to as horsepower control of the hydraulic system.

In the meantime, the actuator includes a linear actuator, in which a rod linearly moves and a hydraulic motor, in which a shaft rotates.

In the linear actuator, a piston rod is inserted into a cylinder, and first and second ports are formed at both sides of the cylinder. When working oil is supplied to the first port at one side, the piston rod is pushed by the working oil, and the working oil is discharged through the second port by the pushed piston rod. However, a flow rate of the working oil entering through the first port is different from a flow rate of the working oil discharged from the second port. The reason of the difference in the working oil is a difference by a cross-section area of the piston rod. More specifically, the cylinder having no piston rod has a large cross-sectional area corresponding to an internal diameter of the cylinder, and the cylinder having a cylinder rod has a small cross-sectional area corresponding to a cross-sectional area obtained by subtracting a cross-sectional area of the cylinder rod from the internal diameter of the cylinder, so that the flow rates of the working oil at both sides of the piston rod are different due to the difference in the cross-sectional area.

As described above, there is a difference between the flow rate of the inflow working oil and the flow rate of the discharged working oil when the actuator is driven, so that there is a problem in that an operation speed of the actuator is decreased due to the difference in the flow rate of the working oil.

More specifically, a charging hydraulic circuit is configured to supplement a flow rate from a side, at which the flow rate is excessive, to a side, at which the flow rate is insufficient, and an operation speed of the actuator is decreased during a process of charging the working oil.

SUMMARY

Accordingly, a technical object to be solved by the present disclosure is to provide a hydraulic system for a construction machine, which prevents working oil from being recirculated from an accumulator when a difference between a first flow rate entering an actuator and a second flow rate discharged from the actuator during an operation of the actuator is slight, thereby preventing an operation speed of the actuator from being decreased.

Another technical object to be solved by the present disclosure is to provide a hydraulic system for a construction machine, which prevents first and second check valve units from being simultaneously opened in a control valve unit for a hydraulic system for a construction machine, thereby preventing an erroneous operation of an actuator.

In order to achieve the technical object, an exemplary embodiment of the present disclosure provides a hydraulic system for a construction machine, including: a pump/motor 140 configured to serve as both a hydraulic pump driven by an engine and discharging working oil and a motor generating rotational force by the working oil; an actuator 170 operated by receiving hydraulic pressure from the pump/motor 140 and provided with first and second ports 170*a* and 170*b* through which the hydraulic pressure flows in and out; first and second hydraulic pressure lines 1La and 1Lb configured to connect the pump/motor 140 and the actuator 170; an accumulator 180 configured to store or discharge the working oil through the first and second hydraulic pressure lines 1La and 1Lb and first and second bypass lines 1411 and 1412; first and second check valve units 610 and 620 provided on the first and second bypass lines 1411 and 1412 respectively, and configured to allow the working oil to move only to the first and second hydraulic pressure lines 1La and 1Lb; and a control valve unit 200, of which both pressure receiving portions are connected with the first and second hydraulic pressure lines 1La and 1Lb, and switched so that a hydraulic pressure line having lower pressure between the first and second hydraulic pressure lines communicates with the accumulator 180.

In order to achieve the technical object, another exemplary embodiment of the present disclosure provides a hydraulic system for a construction machine, including: a pump/motor 140 configured to serve as both a pump and a motor; an actuator 170 provided with a first port 170*a* at a head side of a cylinder 172 and a second port 170*b* at a rod side 174 of the cylinder 172; an accumulator 180 configured to store working oil; a first hydraulic pressure line 1La, through which the pump/motor 140 and the first port 170*a* are connected, and in which a first pressure Pa is formed; a second hydraulic pressure line 1Lb, through which the pump/motor 140 and the second port 170*b* are connected, and in which a second pressure Pb is formed; first and second check valve units 610 and 620 provided in first and second bypass lines 1411 and 1412 connected with the first and second hydraulic pressure lines 1La and 1Lb and the accumulator 180, and configured to allow the working oil to move only to the first and second hydraulic pressure lines 1La and 1Lb, respectively; a plurality of relief valve units 160 provided in third and fourth bypass lines 1421 and 1422 connected with the first and second hydraulic pressure lines 1La and 1Lb and the accumulator 180, and configured to maintain the first and second pressures Pa and Pb to be the same as or lower than set pressure; and a control valve unit 200, in which the first pressure Pa and the second pressure Pb are applied to both sides of a spool, configured to control higher pressure to be blocked from the accumulator 180 and lower pressure to be connected with the accumulator 180 when the higher pressure is formed in any one of the first and second pressures Pa and Pb.

Further, in the hydraulic system for the construction machine according to the present disclosure, the control valve unit 200 may include an internal flow path including a second position 202 connecting the first hydraulic pressure line 1La and the accumulator 180, a third position 203 connecting the second hydraulic pressure line 1Lb and the accumulator 180, and a first position 201 blocking hydraulic pressure from flowing to any one side, and have a spool structure, in which the first pressure Pa and second pressure Pb of the first and second hydraulic pressure lines 1La and 1Lb are applied to both pressure receiving portions.

Further, in the hydraulic system for the construction machine according to the present disclosure, when the first pressure Pa and the second pressure Pb are within a predetermined range, the spool of the control valve unit 200 may be maintained at the first position 201.

Further, in the hydraulic system for the construction machine according to the present disclosure, when the first pressure Pa is higher than the second pressure Pb, the control valve unit 200 may be switched so that the second pressure line 1Lb is connected with the accumulator 180, and the first pressure Pa is applied to the actuator 170, when the first pressure Pa is lower than the second pressure Pb, the control valve unit 200 may be switched so that the first pressure line 1La is connected with the accumulator 180, and the second pressure Pb is applied to the actuator 170, and when the first pressure Pa is the same as the second pressure Pb, the control valve unit 200 may be switched so that the first and second pressure lines 1La and 1Lb are blocked from the accumulator 180.

Further, in the hydraulic system for the construction machine according to the present disclosure, the third and fourth bypass lines 1421 and 1422 connecting the first and second hydraulic pressure lines 1La and 1Lb and the accumulator 180 may be installed between the first and second hydraulic pressure lines 1La and 1Lb and the accumulator 180, and the hydraulic system may further include the relief valve units 160, which open and close the third and fourth bypass lines 1421 and 1422 so that the hydraulic pressure is supplied to the accumulator 180 when hydraulic pressure of the first and second hydraulic pressure lines 1La and 1Lb is higher than set pressure, on the third and fourth bypass lines 1421 and 1422.

Further, in the hydraulic system for the construction machine according to the present disclosure, the control valve unit 200 may include: a valve block 210, in which a first valve flow path 222 is formed so that a first valve port p1 communicates with a second valve port p2, a second valve flow path 224 is formed so that a third valve port p3 communicates with a fourth valve port p4, a third valve flow path 226 communicating with the accumulator is formed, a spool hole 230 communicating with the first, second, and third valve flow paths 222, 224, and 226 is formed, and a check valve hole 240 communicating with the first, second, and third valve flow paths 222, 224, and 226 is formed; and a spool 300 disposed in the spool hole 230, and configured to make lower hydraulic pressure between the first pressure of the first valve flow path 222 and the second pressure of the second valve flow path 224 communicate with the third valve flow path 226.

Further, in the hydraulic system for the construction machine according to the present disclosure, first and second chambers 341 and 342 may be formed at both sides of the spool 300, and a common groove 310 may be formed in an outer peripheral area of a center of the spool 300 so that the first valve flow path 222 communicates with the third valve flow path 226 or the second valve flow path 224 communicates with the third valve flow path 226, a first spool hydraulic pressure line 322 may be formed so that the first valve flow path 222 communicates with the first chamber 341, a second spool hydraulic pressure line 324 may be formed so that the second valve flow path 224 communicates with the second chamber 342, and first and second spool orifice hydraulic pressure lines 332 and 334 may be formed in the first and second spool hydraulic pressure lines 322 and 324, respectively, so that the first pressure and the second pressure may compete with each other at both ends of the spool 300, and the spool 300 may move to a lower pressure side.

Further, in the hydraulic system for the construction machine according to the present disclosure, first and second orifices 402 and 404 may be formed in the first and second spool orifice hydraulic pressure lines 332 and 334, respectively, and response speed of the spool 300 may be determined by the first and second orifices 402 and 404.

Further, in the hydraulic system for the construction machine according to the present disclosure, first and second orifice units 410 and 420 may be formed in the first and second spool orifice hydraulic pressure lines 332 and 334, respectively, first and second orifice holes 412 and 414 may be formed in the first and second orifice units 410 and 420, respectively, and response speed of the spool 300 may be determined by the first and second orifice holes 412 and 414.

Further, in the hydraulic system for the construction machine according to the present disclosure, the first and second orifice units 410 and 420 may be replaced with other orifice units having different sizes of internal diameters of the first and second orifice holes 412 and 414, so that the response speed of the spool 300 may be adjusted.

Further, the hydraulic system for the construction machine according to the present disclosure may further include: a first check valve unit 610 provided in the first valve flow path 222 and the check valve hole 240 and opened when the first pressure is lower than a third pressure of the third valve flow path 226; and a second check valve unit 620 provided in the second valve flow path 224 and the check valve hole 240 and opened when the second pressure is lower than the third pressure.

In the hydraulic system for the construction machine according to the present disclosure, which is configured as described above, a difference between a flow rate entering the actuator and a flow rate discharged from the actuator is essentially generated when the actuator is operated, but even when the pressure difference is small to be ignorable, it is possible to prevent working oil from being recirculated in the working oil charging hydraulic circuit, and improve workability by preventing an operation speed of the actuator from being decreased.

Further, in the hydraulic system for the construction machine according to the present disclosure, even though pressure lower than pressure of the accumulator is formed in both the first and second hydraulic pressure lines, the spool always moves to any one side and is supplemented with a flow rate, so that the pressure of any one line between the first and second hydraulic pressure lines is balanced with the pressure of the accumulator. Accordingly, any one of the first and second check valve units always maintains a closed state, and the other is opened, so that the first and second check valve units 610 and 620 are clearly operated. Further, it is possible to stably provide working oil to the actuator 170, thereby smoothly progressing a desired operation.

Figure 1:
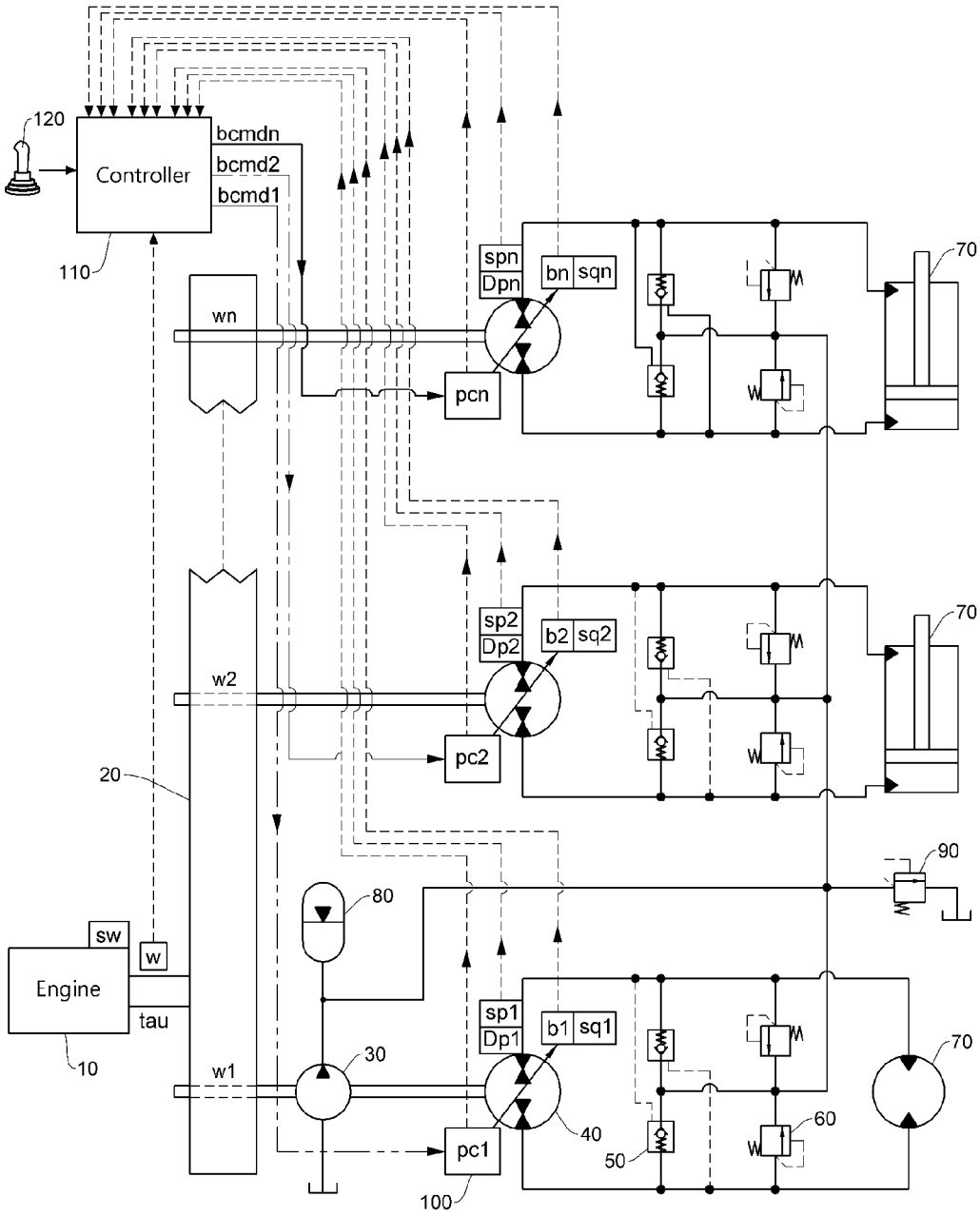
FIG. 1 is a diagram of a hydraulic circuit for describing a hydraulic system for a construction machine.

| Description of Main Reference Numerals of the Drawings | |
|---|---|
| 10: Engine | 20: Power distributing unit |
| 30: Charging pump | 40, 140: Pump/motor |
| 50: Check valve unit | 50a, 50b: First and second check valve units |
| 61, 62: First and second pressure signal lines | |
| 160: Relief valve unit | |
| 70, 170: Actuator | 170a, 170b: First and second actuator ports |
| 80, 180: Accumulator | |
| 90: Charging relief valve | 100: Pump/motor controller |
| 110: Controller | 120: Operating unit |
| 131, 132, 133: First, second, and third hydraulic pressure lines | |
| 200: Control valve unit | |
| 201, 202, 203: First, second, and third positions | |
| 210: Valve block | |
| 222, 224, 226: First, second, and third valve flow paths | |
| 230: Spool hole | |
| 240: Check valve hole | |
| 300: Spool | |
| 310: Command groove | |
| 322, 324: First and second hydraulic pressure lines | |
| 332, 334: First and second spool orifice hydraulic pressure lines | |
| 402, 404: First and second orifices | |
| 410, 420: First and second orifice units | |
| 412, 414: First and second orifice holes | |
| 411, 412: First and second bypass lines | |
| 421, 422: Third and fourth bypass lines | |
| 1411, 1412: First and second bypass lines | |
| 1421, 1422: Third and fourth bypass lines | |
| 512, 514: First and second spool restoring springs | |
| 522, 524: First and second spool caps | |
| 610, 620: First and second check valve units | |
| 612, 614: First and second poppet holes | |
| 622, 624: First and second poppets | |
| 632, 634: First and second poppet springs | |
| 642, 644: First and second caps | |
| sw: RPM sensor | |
| sp1, sp2, . . . , spn: Working oil pressure sensor | |
| sq1, sq2, . . . , sqn: Swash plate angle sensor | |
| w: Engine rpm | |
| w1, w2, . . . , wn: RPM of each pump/motor | |
| b1, b2, . . . , bn: Capacity of each pump/motor | |
| bcmd1, bcmd2, . . . , bcmdn: Control command for each pump/motor | |
| Dp1, Dp2, . . . , Dpn: Difference between pressures of inlet and outlet of each pump/motor | |
| La, Lb: First and second hydraulic pressure lines | |
| 1La, 1Lb, 33: First, second, and third hydraulic pressure lines | |
| p1, p2, p3, p4, p5: First, second, third, fourth, and fifth valve ports | |
| pc1, pc2, . . . , pcn: Controller of each pump/motor | |

DETAILED DESCRIPTION

Advantages and characteristics of the present disclosure, and a method of achieving the advantages and characteristics will be clear with reference to an exemplary embodiment described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be modified to be variously carried out differently from the exemplary embodiment described herein. In the following description of the present disclosure, a detailed description and a detailed illustration of publicly known functions or constituent elements incorporated herein will be omitted when it is determined that the detailed description may make the subject matter of the present disclosure unclear. In addition, for helping the understanding of the present disclosure, the accompanying drawings are not illustrated based on actual scales, but parts of the constituent elements may be exaggerated in terms of sizes.

Meanwhile, the terms used in the description are defined considering the functions of the present disclosure and may vary depending on the intention or usual practice of a producer. Therefore, the definitions should be made based on the entire contents of the present specification.

Like reference numerals indicate like constituent elements throughout the specification.

First Comparative Example

First, a hydraulic circuit for storing/supplementing working oil according to a Comparative Example, which is applied to a hydraulic system for a construction machine, will be described with reference to FIGS. 1 to 3.

A hydraulic system for a construction machine in the related art has a configuration, in which a main pump discharges working oil from one or two pumps, and a main control valve MCV distributes working oil to each actuator. However, in the hydraulic system provided with the main control valve, that is a problem in that pressure loss is generated while the working oil passes through the main control valve, so that energy efficiency is low.

As a hydraulic system for improving energy efficiency, a hydraulic system, in which each actuator includes an independent pump/motor, and a corresponding actuator is controlled by controlling the pump/motor, has been developed.

The hydraulic system is operated by receiving a flow rate from the bi-directional type pump/motor of each actuator, and there is no separate metering valve (control valve), so that since there is no resistance when working oil passes through various valves, there is little pressure loss of the working oil, and as a result, energy efficiency for actually operating the actuator is high.

A "hydraulic system" described below means a hydraulic system, in which an independent bi-directional pump/motor is allocated to each actuator, and will be described with reference to FIG. 1. FIG. 1 is a diagram of a hydraulic circuit for describing a hydraulic system for a construction machine.

As illustrated in FIG. 1, the hydraulic system includes an engine 10 generating power, a power distributing unit 20 distributing the power generated by the engine 10 to a plurality of pumps/motors 40, and an actuator 70 operated by working oil discharged from each pump/motor 40.

The pump/motor 40 is a hydraulic constituent element serving as both a hydraulic pump and a hydraulic motor. That is, the pump/motor 40 may be used as a hydraulic pump when it is desired to operate the actuator 70, and by contrast, the pump/motor 40 may be used as a hydraulic motor when working oil flows by kinetic energy or inertial energy of the actuator 70.

When the pump/motor 40 is used as the hydraulic motor, it may assist with the torque driven by the engine 10. Particularly, power of the engine 10 rotates a shaft of each pump/motor 40 by the power distributing unit 20, and when the pump/motor 40 is operated as the hydraulic motor by potential energy/inertial energy generated by the actuator 70, the shaft of the pump/motor 40 adds rotational force in a direction, in which the shaft of the pump/motor 40 has rotated by the power of the engine, so that there is an effect in that a load of the engine is reduced.

In the meantime, a charging pump 30 is provided at one side of the plurality of pumps/motors 40, and the charging pump 30 discharges working oil and stores energy in an accumulator 80.

In the aforementioned hydraulic system, when an operating unit 120 is operated, control commands bcmd1, bcmd2, . . . , and bcmdn for the pump/motor 40 to control the actuator 70 by the operation of the operating unit 120 are generated.

The control commands bcmd1, bcmd2, . . . , and bcmdn are provided to a pump/motor controller 100. More particularly, the control commands bcmd1, bcmd2, . . . , and bcmdn are provided to pump/motor controllers pc1, pc2, . . . , and pcn, respectively, to control an angle of a swash plate provided in the pump/motor 40.

In the meantime, the pumps/motors 40 include working oil pressure sensors sp1, sp2, . . . , and spn and swash plate angle sensors sq1, sq2, . . . , and sqn, respectively.

Each of the working oil pressure sensors sp1, sp2, . . . , and spn periodically detects pressure of working oil discharged from each pump/motor 40 and provides the detected pressure to the controller 110. Accordingly, the controller 110 calculates differences Dp1, Dp2, . . . , and Dpn in pressure between inlets and outlets of the respective pumps/motors at every moment, where the pressure is detected, and monitors and manages a change in pressure of the working oil discharged from each pump/motor 40.

Each of the swash plate angle sensors sq1, sq2, . . . , and sqn periodically detects a swash plate angle of each pump/motor 40 and provides the detected swash plate angle to the controller 110. The swash plate angle is used as information for calculating a capacity of each pump/motor 40. That is, the controller 110 calculates capacities b1, b2, . . . , and bn of the respective pumps/motors 40 at every moment, where the pressure is detected, and monitors and manages a working oil discharge flow rate discharged from each pump/motor 40.

Further, a working oil charging hydraulic circuit (charging system) is introduced in the hydraulic system. The working oil charging hydraulic circuit includes the charging pump 30, the accumulator 80, and a charging relief valve 90.

The charging pump 30 discharges working oil by the power of the engine, and provides the discharged working oil to the accumulator 80.

The accumulator 80 stores the working oil, and stores pressure energy applied to the working oil.

The charging relief valve 90 is opened when pressure of the charged working oil to be higher than a set pressure is formed, to maintain the set pressure within the working oil charging hydraulic circuit.

Non-described reference numeral sw represents a revolutions per minute (RPM) sensor, non-described reference numeral w represents an rpm, and non-described reference numerals w1, w2, . . . , and wn represent rpms of the pumps/motors, respectively. The rpm is information used for calculating torque formed in working oil.

Figure 2A:
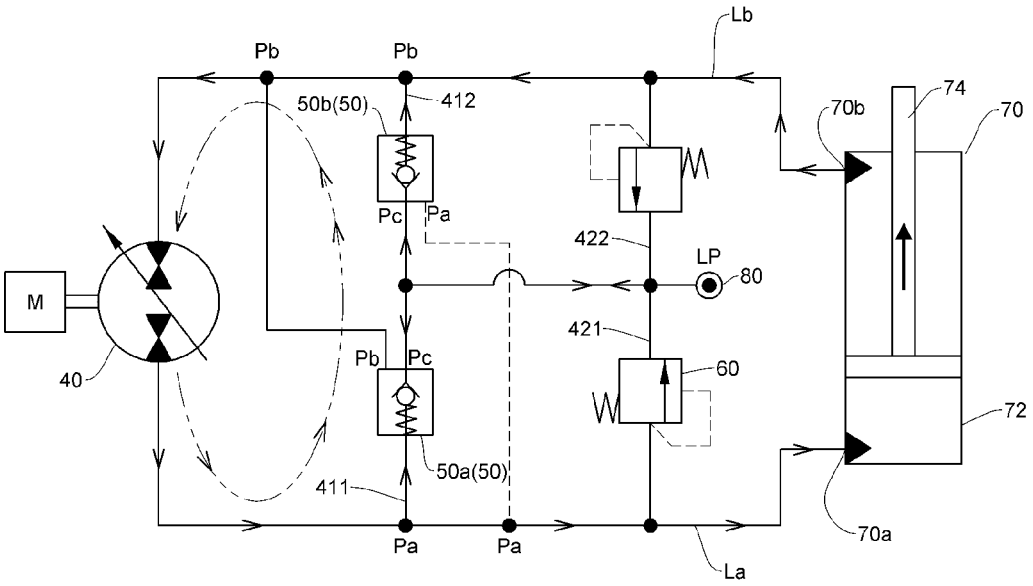
FIGS. 2A and 2B are a diagram of a hydraulic circuit for describing a working oil charging hydraulic circuit according to a Comparative Example in the hydraulic system for the construction machine.
Figure 2B:
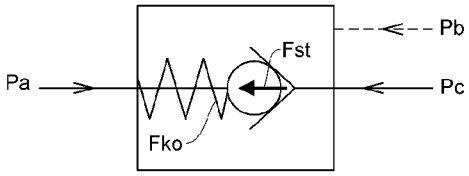

A hydraulic circuit connected with each pump/motor 40 and the actuator 70 will be described with reference to FIG. 2A. FIGS. 2A and 2B are a diagram of a hydraulic circuit for describing a working oil charging hydraulic circuit according to a Comparative Example in the hydraulic system for the construction machine.

As illustrated in FIG. 2A, first and second hydraulic pressure lines La and Lb are connected to the pump/motor 40 and the actuator 70. More particularly, the first hydraulic pressure line La is connected to the pump/motor 40 and a first port 70*a* formed at a head side of a cylinder 72 of the actuator 70. The second hydraulic pressure line Lb is connected to the pump/motor 40 and a second port 70*b* formed at a rod side 74 of the actuator 70.

Further, a plurality of check valve units 50 is provided at first and second bypass lines 411 and 412, respectively, connected to the first and second hydraulic pressure lines La and Lb and the accumulator 80. The check valve unit 50 includes first and second check valve units 50*a* and 50*b*.

The first check valve unit 50*a* blocks a flow of working oil from the first hydraulic pressure line La to the accumulator 80, and allows the working oil to flow from the accumulator 80 to the first hydraulic pressure line La. In the meantime, second pressure Pb of the working oil formed in the second hydraulic pressure line Lb is applied in a direction, in which the first check valve unit 50*a* is opened.

Similarly, the second check valve unit 50*b* blocks a flow of working oil from the second hydraulic pressure line Lb to the accumulator 80, and allows the working oil to flow from the accumulator 80 to the second hydraulic pressure line Lb. In the meantime, a first pressure Pa of the working oil formed in the first hydraulic pressure line La is applied in a direction, in which the second check valve unit 50*b* is opened.

Further, a plurality of relief valve units 60 is provided at third and fourth bypass lines 421 and 422, respectively, connected to the first and second hydraulic pressure lines La and Lb and the accumulator 80. When pressure higher than set pressure is formed in the first and second hydraulic pressure lines La and Lb, the relief valve unit 60 is switched to be opened. Accordingly, the relief valve unit 160 sends some of a flow rate of the high-pressure working oil to the accumulator 80.

The working oil charging hydraulic circuit of the Comparative Example configured as described above is operated as described below.

It is assumed that in FIG. 2A, the pump/motor 40 serves as a motor, and the actuator 70 acts in a direction, in which the rod 74 is extended.

When the rod 74 is extended, working oil flows from the first port 70*a* to the head side of the cylinder 72, and the working oil is discharged through the second port 70*b*. In this case, there is a difference in a flow rate between the inflow working oil and the discharged working oil. More particularly, a cross-sectional area at the head side of the cylinder is large, but a cross-sectional area at a side, at which the rod 74 is disposed, is small by a cross-sectional area of the rod 74. Accordingly, a first flow rate entering/discharged through the first port 70*a* is larger than a second flow rate entering/discharged through the second port 70*b*.

As described above, the first and second pressures Pa and Pb are formed in the first and second hydraulic pressure lines La and Lb, respectively, due to the difference between the first and second flow rates, and the check valve unit 50 is switched to be opened/closed according to a high and low relationship between the first pressure Pa and the second pressure Pb.

The control of opening/closing the check valve unit 50 will be described with reference to FIG. 2B.

The check valve unit 50 is opened when the first pressure Pa is different from the second pressure Pb. In the meantime, the check valve unit 50 is closed when the difference between the first pressure Pa and the second pressure Pb is resolved.

When a small load is formed, in which the first pressure Pa and the second pressure Pb are at a similar level to that of an accumulator pressure Pc, the flow rate of the pump/motor 40 is not all supplied to the actuator 70, but the working oil is recirculated with the accumulator 80 through the check valve unit 50 of the working oil charging hydraulic circuit, so that an operation speed of the actuator 70 is decreased.

For example, as illustrated in FIG. 2B, the actuator 70 may be operated so that the first pressure Pa is slightly higher than the accumulator pressure Pc and the accumulator pressure Pc is slightly higher than the second pressure Pb, and in this case, some of the flow rate of the working oil may be circulated within the accumulator 80.

In order to open the check valve unit 50 and then close the check valve unit 50 in the working oil charging hydraulic circuit, a condition below needs to be satisfied.

A condition, under which the check valve unit 50 is closed, may be explained by Equation 1 below.

$$A2(Pc-Pb)+A1(Pa-Pc)+Fko>Fst \quad \text{[Equation 1]}$$

Pa, Pb: First and second pressures

Pc: Accumulator pressure

A2: Pressure receiving area to which Pb and Pc are applied

A1: Pressure receiving area to which Pc and Pa are applied

Fko: Spring power

Fst: Stop frictional force of poppet

In the Comparative Example, when the first pressure Pa is higher than the accumulator pressure Pc (a general state), a poppet is closed, so that the working oil cannot flow in a reverse direction. However, when a difference between the first pressure Pa and the accumulator pressure Pc is slight, the check valve unit 50 may fail to overcome stop frictional force of the poppet and be maintained in an opened state. In order to improve an action of closing the check valve unit 50, a stronger spring may be applied as a spring provided at the check valve unit 50, but in this case, when energy is stored (charged) in a forward direction, pressure loss is increased, so that energy efficiency of the hydraulic system is degraded.

Figure 3:
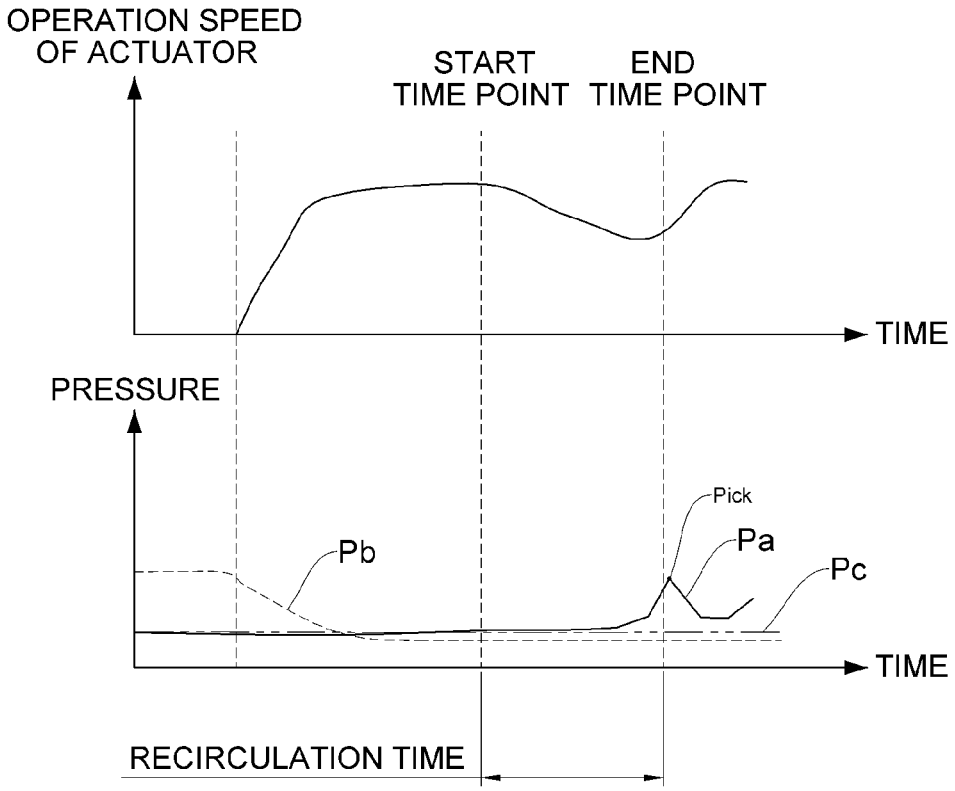
FIG. 3 is a diagram for describing a check valve unit of the Comparative Example illustrated in FIGS. 2A and 2B.

In the meantime, as illustrated in FIG. 3, a working oil recirculation action is incurred from a closing start time point to a closing end time point when the poppet of the check valve unit 50 is opened and closed, and the first pressure Pa is momentarily increased at the end time point, so that pressure peak is formed.

That is, in the working oil charging hydraulic circuit according to the Comparative Example, impact is generated immediately after the operation speed of the actuator 70 is temporarily/momentarily small, and the impact makes the control of the hydraulic circuit difficult.

Second Comparative Example

In general, a hydraulic system is mounted in a construction machine. The hydraulic system operates a pump by power provided by a power source, and forms pressure in working oil by the pump. The working oil is provided to an actuator, and thus the actuator is operated.

Figure 4:
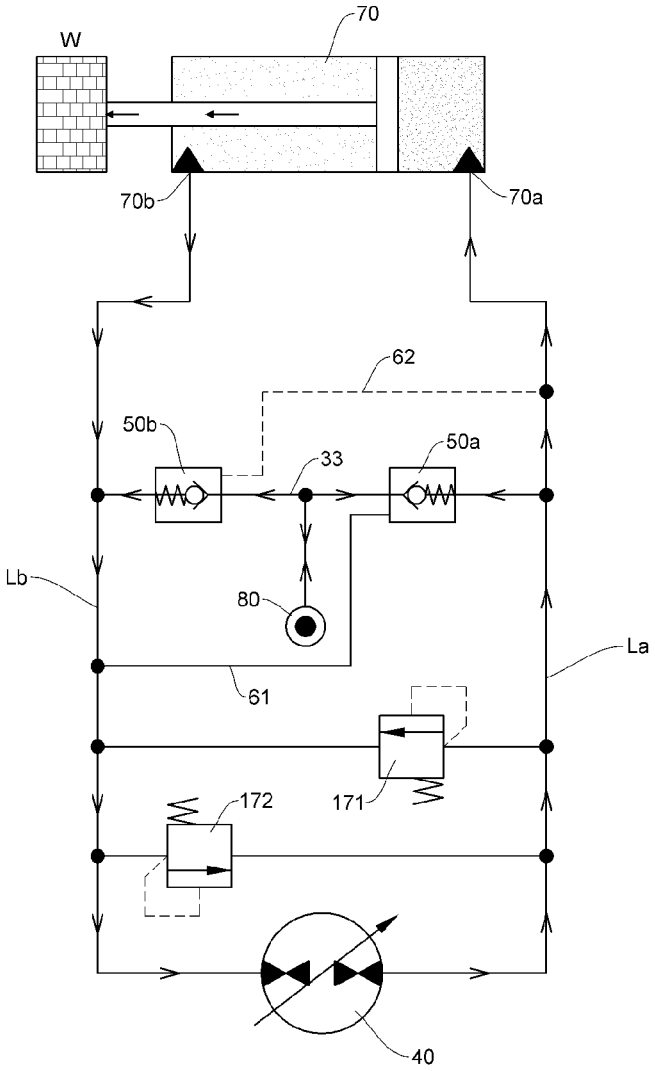
FIG. 4 is a diagram for describing another hydraulic system according to a Comparative Example in the hydraulic system for the construction machine.

A hydraulic system according to a Comparative Example will be described with reference to FIG. 4. FIG. 4 is a diagram for describing another hydraulic system according to a Comparative Example in the hydraulic system for the construction machine.

As illustrated in FIG. 4, in the hydraulic system according to the Comparative Example, a pump/motor 40 and an actuator 70 are connected through first and second hydraulic pressure lines La and Lb. More particularly, the pump/motor 40 and a first actuator port 70*a* of the actuator 70 are connected through the first hydraulic pressure line La. Further, the pump/motor 40 and a second actuator port 70*b* of the actuator 70 are connected through the second hydraulic pressure line Lb. The pump/motor 40 may also serve as a motor.

That is, when the pump/motor 40 is operated to discharge working oil through the first hydraulic pressure line La, the working oil is provided to the first actuator port 70*a* of the actuator 70, and thus the actuator 70 may be operated so that a rod is extended. In the meantime, the working oil to be discharged from the actuator 70 is returned to the pump/motor 40 via the second hydraulic pressure line Lb.

In the meantime, cross-sectional areas of the actuator 70 are different from each other due to a cross-sectional area of the rod, so that a flow rate supplied through the first actuator port 70*a* is different from a flow rate discharged from the second actuator port 70*b*. In order to overcome a difference in a flow rate, an accumulator 80 is provided.

The first and second hydraulic pressure lines La and Lb and the accumulator 80 may be connected through a third hydraulic pressure line 33. A first check valve unit 50*a* is provided between the first hydraulic pressure line La and the accumulator 80, and a second check valve unit 50*b* is provided between the second hydraulic pressure line Lb and the accumulator 80.

Further, the first check valve unit 50*a* and the second hydraulic pressure line Lb are connected through a first pressure signal line 61, and the second check valve unit 50*b* and the first hydraulic pressure line La are connected through a second pressure signal line 62.

The first check valve unit 50*a* is opened when high pressure is formed in the second hydraulic pressure line Lb, and similarly, the second check valve unit 50*b* is opened when high pressure is formed in the first hydraulic pressure line La.

Accordingly, when a flow rate at any one hydraulic pressure line is excessive, the working oil of the hydraulic pressure line is stored in the accumulator 80, and by contrast, when a flow rate at any one hydraulic pressure line is insufficient, the working oil is supplemented from the accumulator 80.

For example, when the pump/motor 40 is operated and the working oil is supplied to the first hydraulic pressure line La, a flow rate of the working oil discharged from the actuator 70 is smaller than the supplied flow rate, so that the flow rate may be insufficient. In this case, a first pressure formed in the first hydraulic pressure line La is higher than a second pressure formed in the second hydraulic pressure line Lb, so that the second check valve unit 50*b* is opened, and thus the working oil is supplied from the accumulator 80 to the second hydraulic pressure line Lb to supplement the insufficient flow rate.

On the other hand, when the pump/motor 40 is reversely rotated and operated and the working oil is supplied to the second hydraulic pressure line Lb, a flow rate of the working oil discharged from the actuator 70 is larger than the supplied flow rate, so that the flow rate may be excessive. In this case, a third pressure formed in the second hydraulic pressure line Lb is higher than a fourth pressure formed in the first hydraulic pressure line La, so that the first check valve unit 50*a* is opened, and thus the working oil of the first hydraulic pressure line La is stored in the accumulator 80 and the excessive flow rate is discharged.

In the meantime, a first relief valve 171 may be provided in a hydraulic pressure line connected from the first hydraulic pressure line La to the second hydraulic pressure line Lb. Further, a second relief valve 172 may be provided in a hydraulic pressure line connected from the second hydraulic pressure line Lb to the first hydraulic pressure line La.

The first and second relief valves 171 and 172 are opened when higher pressure than set pressure is formed. For example, when abnormal high pressure is formed in the first hydraulic pressure line La, the first relief valve 171 is opened to move the working oil of the first hydraulic pressure line La to the second hydraulic pressure line Lb.

However, the hydraulic system of the second Comparative Example has a problem below.

The first and second check valve units 50*a* and 50*b* are valve configurations operated by receiving pressure signals from the first and second pressure signal lines 61 and 62 connected with the pump/motor 40. The valve configuration has a problem in that when pressure formed in the first and second hydraulic pressure lines La and Lb is higher than pressure operating the poppet provided inside the check valve, the first check valve unit 50*a* and the second check valve unit 50*b* are simultaneously opened. Further, by a specific reason that is not clearly investigated, there is a case where the first check valve unit 50*a* and the second check valve unit 50*b* are simultaneously opened.

Particularly, as described above, when the first check valve unit 50*a* and the second check valve unit 50*b* are simultaneously opened, the working oil may not flow to a side, at which a large load W is applied to the actuator 70, but may be returned to the pump/motor 40 or the accumulator 80.

More specifically, as illustrated in FIG. 4, the working oil may be provided in a direction, in which the actuator 70 is expanded, and in this case, the actuator 70 receives resistance so as not to be normally expanded by the load W. Further, the pressure of the first hydraulic pressure line La may increase to abnormal high pressure.

That is, the working oil may not be provided to the actuator 70, and may flow to the pump/motor 40 or the accumulator 80 having a relatively small load. Accordingly, an appropriate flow rate is not provided to the actuator 70, so that there is a problem in that the actuator 70 is not normally operated. That is, there is a problem in that an operation speed of the actuator 70 becomes remarkably decreased or very little torque applied to the load W is formed, so that it is impossible to smoothly perform an operation.

On the other hand, the load W is applied in a direction in which the actuator 70 is contracted, and when all of the first and second check valve units 50*a* and 50*b* are opened, the working oil may be rapidly discharged from the actuator 70, and in this case, the actuator 70 is rapidly operated, so that a dangerous situation may be incurred.

First Exemplary Embodiment

Hereinafter, a hydraulic system for a construction machine, to which a working oil charging hydraulic circuit according to an exemplary embodiment of the present disclosure is applied, will be described with reference to FIGS. 5 and 6.

Figure 5A:
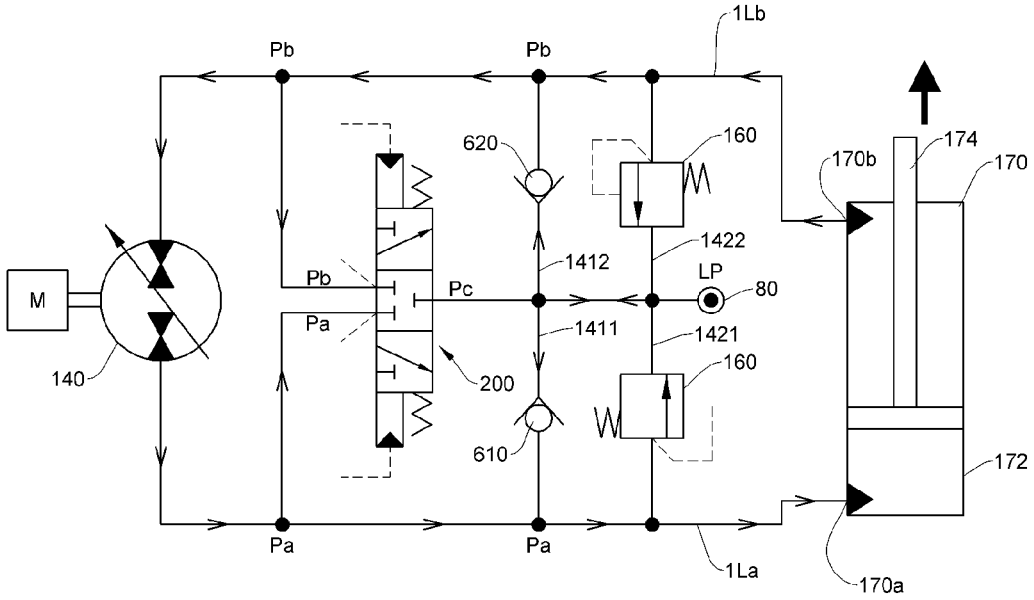
FIGS. 5A and 5B are a diagram of a hydraulic circuit for describing a working oil charging hydraulic circuit according to an exemplary embodiment of the present disclosure in a hydraulic system for a construction machine.
Figure 5B:
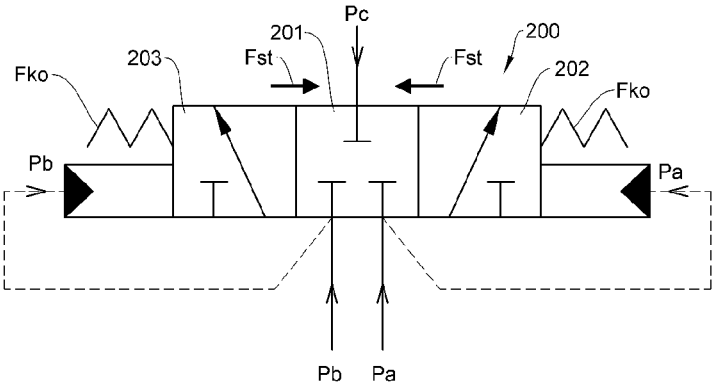

FIGS. 5A and 5B are a diagram of a hydraulic circuit for describing a working oil charging hydraulic circuit according to an exemplary embodiment of the present disclosure in a hydraulic system for a construction machine. FIG. 6 is a diagram for describing a check valve unit according to the exemplary embodiment of the present disclosure illustrated in FIGS. 5A and 5B.

First and second hydraulic pressure lines 1La and 1Lb are connected to a pump/motor 140 and an actuator 170, respectively. More particularly, the first hydraulic pressure line 1La is connected to the pump/motor 140 and a first port 170*a* formed at a head side of a cylinder 172 of the actuator 170. The second hydraulic pressure line 1Lb is connected to the pump/motor 140 and a second port 170*b* formed at a rod side 174 of the actuator 170.

Further, a control valve unit 200 is provided at a bypass line to which the first and second hydraulic pressure lines 1La and 1Lb and an accumulator 180 are connected. Further, first and second check valve units 610 and 620 are provided at other first and second bypass lines 1411 and 1412, respectively, which are connected to the first and second hydraulic pressure lines 1La and 1Lb and the accumulator 180.

The control valve unit 200 includes a first position 201 blocking circulation of the working oil, a second position 202, at which the second hydraulic pressure line 1Lb and the accumulator 180 are connected, and a third position 203, at which the first hydraulic pressure line 1La and the accumulator 180 are connected.

Further, a first pressure Pa and a second pressure Pb are applied to both sides of a spool of the control valve unit 200, respectively, and more specifically, the first pressure Pa is applied to a pressure receiving portion of the second position 202, and the second pressure Pb is applied to a pressure receiving portion of the third position 203. Further, springs for restoring the spool are disposed at both sides of the spool of the control valve unit 200.

The first check valve unit 610 prevents working oil from moving from the first hydraulic pressure line 1La to the accumulator 180, and only allows working oil to move from the accumulator 180 to the first hydraulic pressure line 1La.

Similarly, the second check valve unit 620 prevents working oil from moving from the second hydraulic pressure line 1Lb to the accumulator 180, and only allows working oil to move from the accumulator 180 to the second hydraulic pressure line 1Lb.

The working oil charging hydraulic circuit of the exemplary embodiment of the present disclosure as described above is operated as described below.

It is assumed that in FIG. 5A, the pump/motor 140 serves as a pump, and the actuator 170 acts in a direction, in which a rod 174 is extended.

When the first pressure Pa and the second pressure Pb have a large difference, for example, the first pressure Pa is higher than the second pressure Pb, the spool of the control valve unit 200 moves and the position thereof is switched from the first position 201 to the second position 202. Accordingly, the second hydraulic pressure line 1Lb and the accumulator 180 are connected. In the meantime, a flow direction of working oil is determined according to a high and low relationship between the second pressure Pb and an accumulator pressure Pc, and the working oil moves from a high-pressure side to a low-pressure side. The first pressure Pa is not discharged, but is applied to the actuator 170. Accordingly, an operation speed of the actuator 170 is prevented from being decreased.

In the meantime, the second hydraulic pressure line 1Lb having a relatively low pressure is supplemented with the working oil from the accumulator 180.

On the other hand, relief valve units 160 are provided at third and fourth bypass lines 1421 and 1422, respectively, which are connected to the first and second hydraulic pressure lines 1La and 1Lb and the accumulator 180. When a higher pressure than pressure set in the first and second hydraulic pressure lines 1La and 1Lb is formed, the relief valve unit 160 is opened, so that some of the working oil is stored in the accumulator 180 and pressure lower than or equal to the set pressure is maintained in the first and second hydraulic pressure lines 1La and 1Lb.

The action of the control valve unit 200 will be described in more detail with reference to FIG. 5B.

The position of the control valve unit 200 is switched to the second position 202 or the third position 203 when the first pressure Pa and the second pressure Pb have a difference. In the meantime, the position of the check valve unit 200 is switched to the first position 201 and the check valve unit 200 is closed when the difference between the first pressure Pa and the second pressure Pb is resolved.

In the control valve unit 200 according to the present disclosure, even though a small load is formed, in which the first pressure Pa and the second pressure Pb are at a similar level to that of the accumulator pressure Pc, a flow rate of the pump/motor 140 is completely supplied to the actuator 170, and the first and second high pressures Pa and Pb are applied to the actuator 170 as they are in the working oil charging hydraulic circuit according to the present disclosure. Accordingly, an operation speed of the actuator 170 is applied at a normal speed.

For example, as illustrated in FIG. 5B, the actuator 170 may be operated so that the first pressure Pa is slightly higher than the accumulator pressure Pc and the accumulator pressure Pc is slightly higher than the second pressure Pb.

In the exemplary embodiment according to the present disclosure, a variable, by which the spool of the control valve unit 200 is operated, is switched by a difference between the first and second pressures Pa and Pb. That is, the accumulator pressure Pc does not influence the switch operation of the control valve unit 200.

In order to open the control valve unit 200 and then close the control valve unit 200 in the working oil charging hydraulic circuit according to the present disclosure, a condition below needs to be satisfied.

A condition, under which the control valve unit 200 is closed, may be explained by Equation 2 below.

$$A(Pa-Pb)+Fko>Fst \quad \text{[Equation 2]}$$

Pa: First pressure

Pb: Second pressure

A: Pressure receiving area to which Pa and Pc are applied

Fko: Spring power

Fsf: Stop frictional force of a poppet

That is, even when the first pressure Pa is slightly higher than the second pressure Pb, a pressure difference has a positive number value, and in a case where power of the spring is added to a value obtained by multiplying the positive number value by a pressure receiving area A, a larger value than that of stop frictional force Fsf of a poppet is obtained, so that the spool of the control valve unit 200 moves. As a result, the position of the control valve unit 200 is switched to the second position 202, so that the control valve unit 200 is more certainly closed so as to prevent the first pressure Pa from being discharged to the accumulator 80.

Accordingly, the working oil charging hydraulic circuit according to the present disclosure may prevent loss of a flow rate to operate the actuator 170, and further prevent energy efficiency of the hydraulic system from deteriorating.

Figure 6:
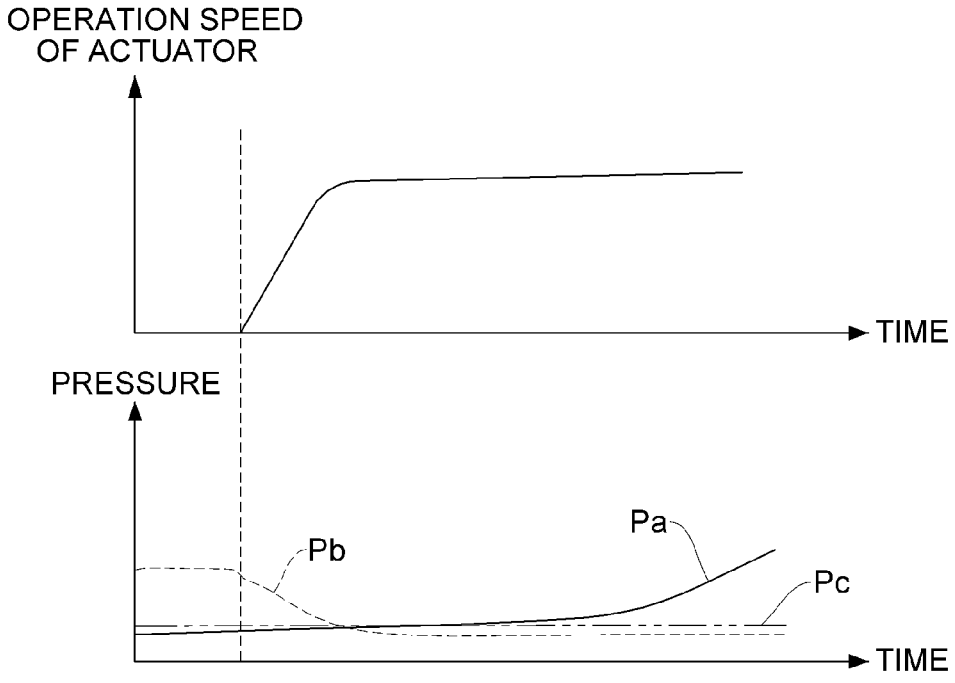
FIG. 6 is a diagram for describing a check valve unit according to the exemplary embodiment of the present disclosure illustrated in FIGS. 5A and 5B.

In the meantime, as illustrated in FIG. 6, when the control valve unit 200 is returned to the first position 201 from the second position 202 or the third position 203 and closed, a working oil recirculation action is not incurred. Particularly, a speed, at which the actuator 170 is operated, is maintained, so that controllability of the actuator 170 is improved.

On the other hand, in the working oil charging hydraulic circuit according to the present disclosure, the first pressure Pa is gently increased, so that impact according to the switch of the control valve unit 200 is not generated.

In the hydraulic system for the construction machine according to the present disclosure, which is configured as described above, a difference between a flow rate entering the actuator and a flow rate discharged from the actuator is essentially generated when the actuator is operated, but even when a difference in pressure between an inlet line and an outlet line of the actuator is small to be ignorable, it is possible to prevent working oil from recirculated in the working oil charging hydraulic circuit, and improve workability by preventing an operation speed of the actuator from being decreased.

Second Exemplary Embodiment

Hereinafter, a control valve unit for a hydraulic system for a construction machine according to an exemplary embodiment of the present disclosure will be described with reference to FIGS. 7 to 9.

Figure 7:
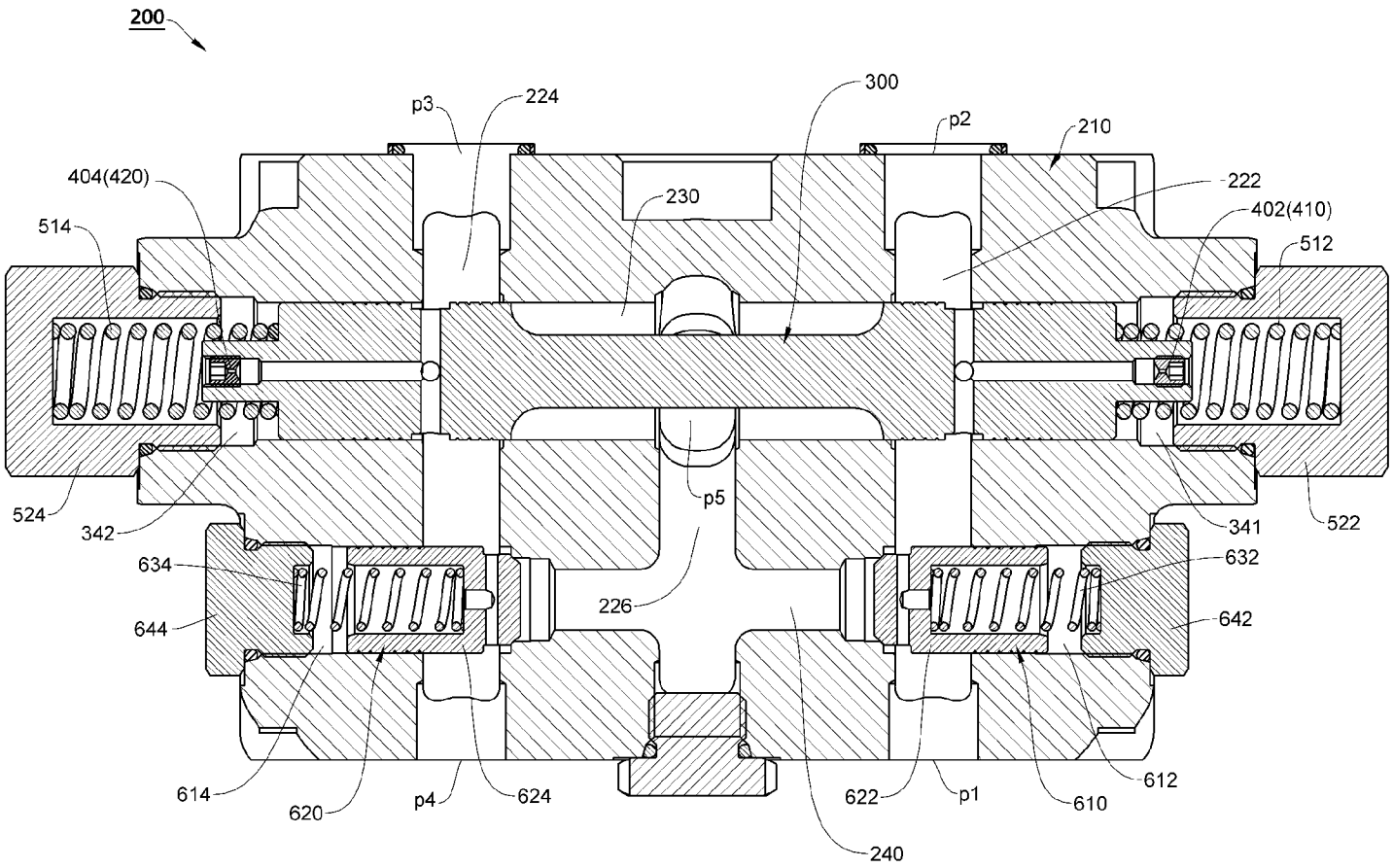
FIG. 7 is a diagram for describing an example of a control valve unit for the hydraulic system for the construction machine according to the exemplary embodiment of the present disclosure.
Figure 8:
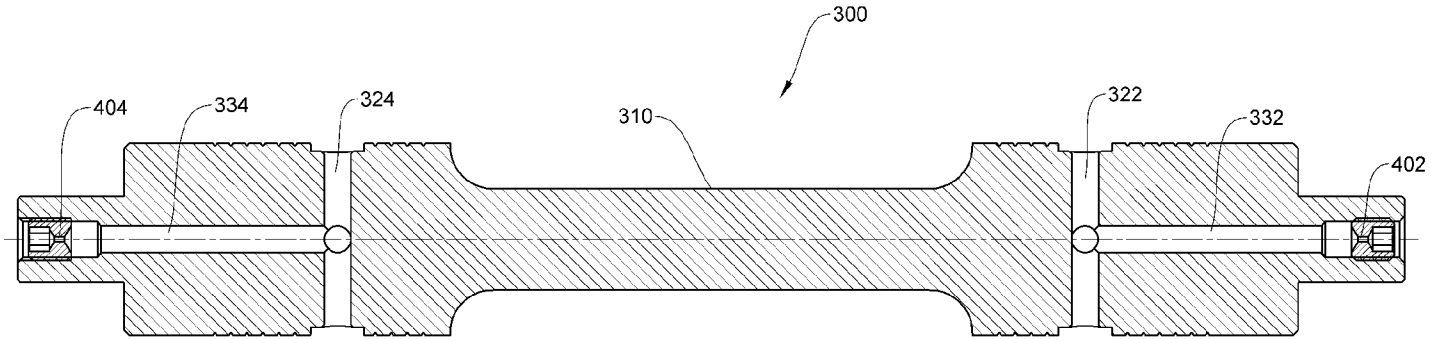
FIG. 8 is a diagram for describing a spool in the control valve unit for the hydraulic system for the construction machine according to the exemplary embodiment of the present disclosure.

FIG. 7 is a diagram for describing an example of a control valve unit for the hydraulic system for the construction machine according to the exemplary embodiment of the present disclosure. FIG. 8 is a diagram for describing a spool in a control valve unit for the hydraulic system for the construction machine according to the exemplary embodiment of the present disclosure. FIG. 9 is a diagram for describing a hydraulic system for a construction machine, to which a control valve according to the exemplary embodiment of the present disclosure is applied.

A control valve unit 200 for the hydraulic system for the construction machine according to the exemplary embodiment of the present disclosure includes a valve block 210, a spool 300, and first and second check valve units 610 and 620.

In the valve block 210, a first valve flow path 222 is formed so that a first valve port p1 is connected with a second valve port p2. The first valve port p1 is connected with a first pump port 141 of a pump/motor 140. The second valve port p2 is connected with a first actuator port 170*a* of an actuator 170.

Further, in the valve block 210, a second valve flow path 224 is formed so that a third valve port p3 is connected with a fourth valve port p4. The third valve port p3 is connected with a second actuator port 170*b* of the actuator 170. The fourth valve port p4 is connected with a second pump port 142 of the pump/motor 140.

Further, a third valve flow path 226 is formed in the valve block 210, and the third valve flow path 226 is connected with an accumulator 180.

Further, in the valve block 210, a spool hole 230 is formed so that the first, second, and third valve flow paths 222, 224, and 226 communicate with each other, and a check valve hole 240 is formed so that the first, second, and third valve flow paths 222, 224, and 226 communicate with each other.

In the meantime, in the valve block 200, first and second chambers 341 and 342 are formed at both sides of the spool 300, respectively.

The first and second chambers 341 and 342 are provided with first and second spool restoring springs 512 and 514, respectively, and are closed by first and second spool caps 522 and 524, respectively.

The first and second spool restoring springs 512 and 514 are disposed at both ends of the spool 300, so that the first and second spool restoring springs 512 and 514 apply restoration force so that the spool 300 is maintained at a neutral position in the valve block 200 when artificial external force is not applied to the spool 300.

The spool 300 is disposed in the spool hole 230 to connect a hydraulic pressure line, which has lower pressure between a first pressure of the first valve flow path 222 and a second pressure of the second valve flow path 224, to the third valve flow path 226.

The spool 300 is provided with a common groove 310 in an outer peripheral area of a center thereof. The common groove 310 connects the first valve flow path 222 and the third valve flow path 226, or connects the second valve flow path 224 and the third valve flow path 226. That is, when the spool 300 leans toward any one side, the common groove 310 connects the third valve flow path 226 to any one between the first valve flow path 222 and the second valve flow path 224.

Further, the spool 300 is provided with a first spool hydraulic pressure line 322 so that the first valve flow path 222 is connected with the first chamber 341. Similarly, the spool 300 is provided with a second spool hydraulic pressure line 324 so that the second valve flow path 224 is connected with the second chamber 342.

First and second spool orifice hydraulic pressure lines 332 and 334 are formed in the first and second spool hydraulic pressure lines 322 and 324, respectively, and thus, the first pressure and the second pressure compete with each other at both ends of the spool 300. Finally, the spool 300 moves to a lower pressure side between the first and second pressures.

On the other hand, first and second orifices 402 and 404 may be formed in the first and second spool orifice hydraulic pressure lines 332 and 334, respectively. The first and second orifices 402 and 404 form resistance in a flow of working to determine a response speed of the spool 300 when the spool 300 moves by a difference between the first and second pressures. For example, when sizes of internal diameters of the first and second orifices 402 and 404 are large, a flow speed of the working oil is large, so that the spool 300 more sensitively responds to the aforementioned pressure difference. By contrast, when sizes of internal diameters of the first and second orifices 402 and 404 are small, a flow speed of the working oil is small, so that the spool 300 less sensitively responds to the aforementioned pressure difference.

On the other hand, first and second orifice units 410 and 420 may be provided in the first and second spool orifice hydraulic pressure lines 332 and 334, respectively.

Figure 10:
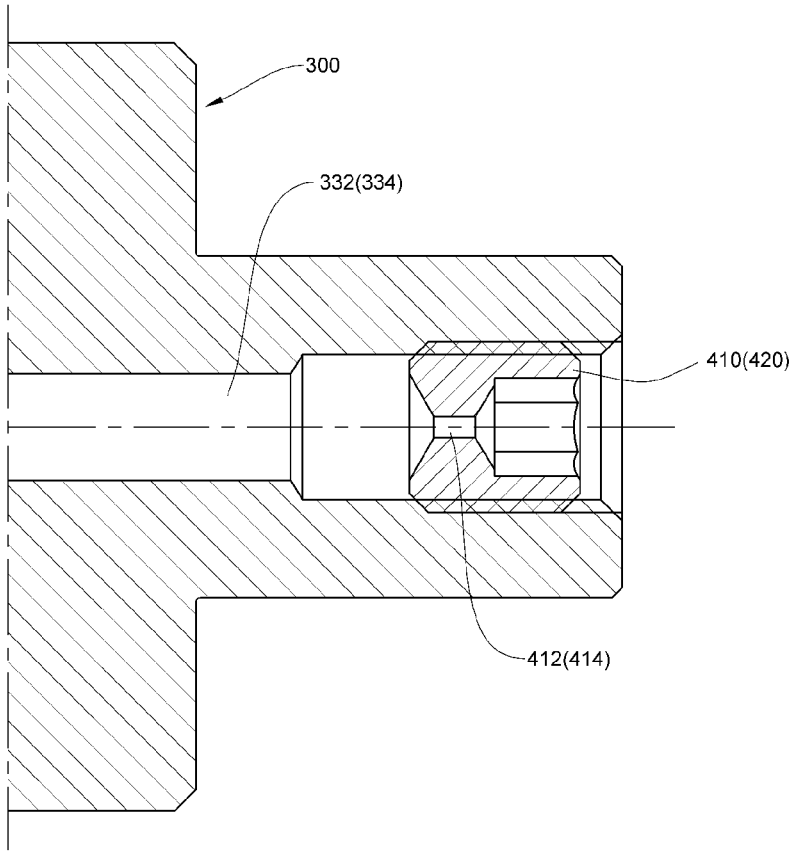
FIG. 10 is a diagram for describing an example of an orifice in the control valve unit for the hydraulic system for the construction machine according to the exemplary embodiment of the present disclosure.

The first and second orifice units 410 and 420 will be described with reference to FIG. 10. FIG. 10 is a diagram for describing an example of an orifice in the control valve unit for the hydraulic system for the construction machine according to the exemplary embodiment of the present disclosure.

First and second orifice holes 412 and 414 are formed in the first and second orifice units 410 and 420, respectively. The first and second orifice holes 412 and 414 form resistance in a flow of working to determine a response speed of the spool 300 when the spool 300 moves by a difference between the first and second pressures. For example, when sizes of internal diameters of the first and second orifice holes 412 and 414 are large, a flow speed of the working oil is large, so that the spool 300 more sensitively responds to the aforementioned pressure difference. By contrast, when sizes of internal diameters of the first and second orifice holes 412 and 414 are small, a flow speed of the working oil is small, so that the spool 300 less sensitively responds to the aforementioned pressure difference.

In the meantime, the orifice units 410 and 420 are replaceably installed, so that when the orifice units 410 and 420 are damaged or the first and second orifice holes 412 and 414 are blocked by foreign substances, the orifice units 410 and 420 may be replaced with new products. Accordingly, the control valve unit 200 may maintain good performance.

Further, the first and second orifice units 410 and 420 may be replaced with other orifice units, in which the sizes of the internal diameters of the first and second orifice holes 412 and 414 are different. That is, a response speed of the spool 300 may be adjusted by replacing the first and second orifice units 410 and 420 with other orifice units, in which the sizes of the internal diameters of the first and second orifice holes 412 and 414 are different.

Further, in the valve block 200, first and second poppet holes 612 and 614 are formed at both sides of the check valve hole 240, respectively.

The first check valve unit 610 is provided at the first valve flow path 222 and the check valve hole 240, so that when the first pressure is lower than the third pressure of the third valve flow path 226, the first check valve unit 610 is opened.

The second check valve unit 620 is provided at the second valve flow path 224 and the check valve hole 240, so that when the second pressure is lower than the third pressure of the third valve flow path 226, the second check valve unit 620 is opened.

The first and second check valve units 610 and 620 are provided with first and second poppets 622 and 624 in the first and second poppet holes 612 and 614, respectively. The first and second poppets 622 and 624 are provided with first and second poppet springs 632 and 634, respectively.

In the meantime, communication holes are formed in the first and second poppets 622 and 624, respectively, and the communication holes enable the working oil filled in the first and second poppet holes 612 and 614 to smoothly move when the first and second poppets 622 and 624 move. Accordingly, the communication holes prevent resistance by the working oil filled in the first and second poppet holes 612 and 614 from hindering the movement of the first and second poppets 622 and 624.

Further, first and second caps 642 and 644 are fastened at external sides of the first and second poppet springs 632 and 634, respectively. The first and second caps 642 and 644 block the first and second poppet holes 612 and 614 from the outside, respectively.

The first and second poppet springs 632 and 634 apply restoration force so that the first and second poppets 622 and 624 move toward the check valve hole 240. That is, when the first poppet 622 maximally moves from the first poppet hole 612 toward the check valve hole 240, the first valve flow path 222 and the third valve flow path 226 are disconnected. Similarly, when the second poppet 624 maximally moves from the second poppet hole 614 toward the check valve hole 240, the second valve flow path 224 and the third valve flow path 226 are disconnected.

Hereinafter, the actions of the hydraulic system for the construction machine and the control valve unit according to the exemplary embodiment of the present disclosure will be described with reference to FIGS. 7, 9, and 11 to 14.

Figure 9:
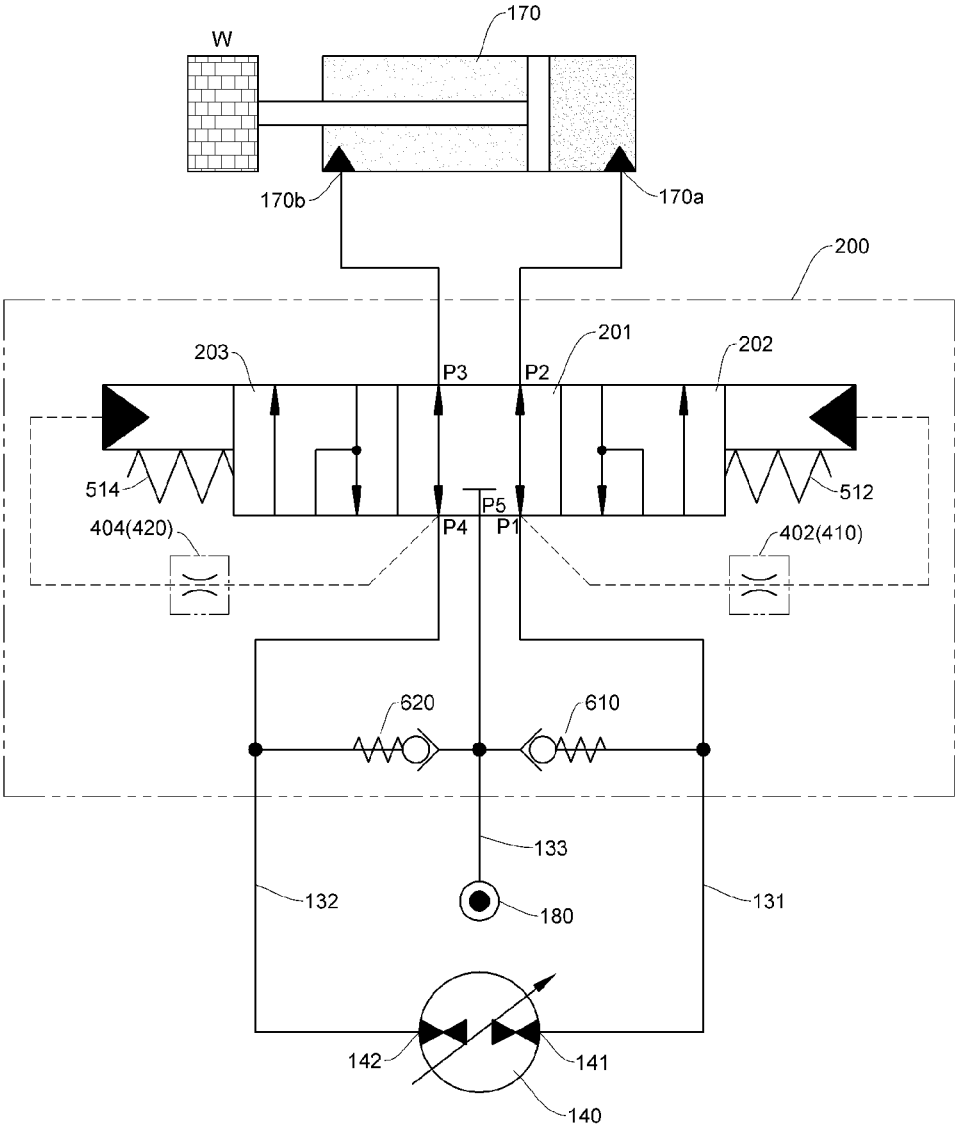
FIG. 9 is a diagram for describing a hydraulic system for a construction machine, to which a control valve according to the exemplary embodiment of the present disclosure is applied.

FIGS. 7 and 9 are an example, in which the spool 300 is positioned at the first position 201 in the control valve unit 200. The first position 201 is a neutral state, in which the spool 300 is maintained at a center position. A difference in pressure between the first chamber 341 and the second chamber 342 is little at the first position 201. For example, the first position 201 may be a state, in which the pump/motor 140 and the actuator 170 are not operated.

In the meantime, the hydraulic system for the construction machine according to the exemplary embodiment of the present disclosure includes the pump/motor 140, the control valve unit 200, the actuator 170, and the accumulator 180 as illustrated in FIG. 9.

First and second pump ports 141 and 142 are formed at both ends of the pump/motor 140. The first pump port 141 is connected with the first valve port p1 through the first hydraulic pressure line 131. Further, the second pump port 142 is connected with the fourth valve port p4 through the second hydraulic pressure line 132.

The first actuator port 170*a* of the actuator 170 is connected with the second valve port p2. The first actuator port 170*a* may be the head side of the actuator 170.

Further, the second actuator port 170*b* of the actuator 170 is connected with the third valve port p3. The second actuator port 170*b* may be the rod side of the actuator 170.

That is, when a first working oil flow rate moves in the first actuator port 170*a* and a second working oil flow rate moves in the second actuator port 170*b*, the first working oil flow rate is different from the second working oil flow rate. More particularly, the first working oil flow rate is larger than the second working oil flow rate.

The accumulator 180 is connected with a fifth valve port p5 through the third hydraulic pressure line 133. The accumulator 180 may maintain set pressure by an auxiliary pump and the relief valve. For example, 30 bar may be set in the accumulator 180, and when pressure is lower than the set pressure, the auxiliary pump is operated to reach 30 bar, and when pressure is higher than the set pressure, the relief valve is operated to discharge some of the working oil and maintain 30 bar.

Figure 11:
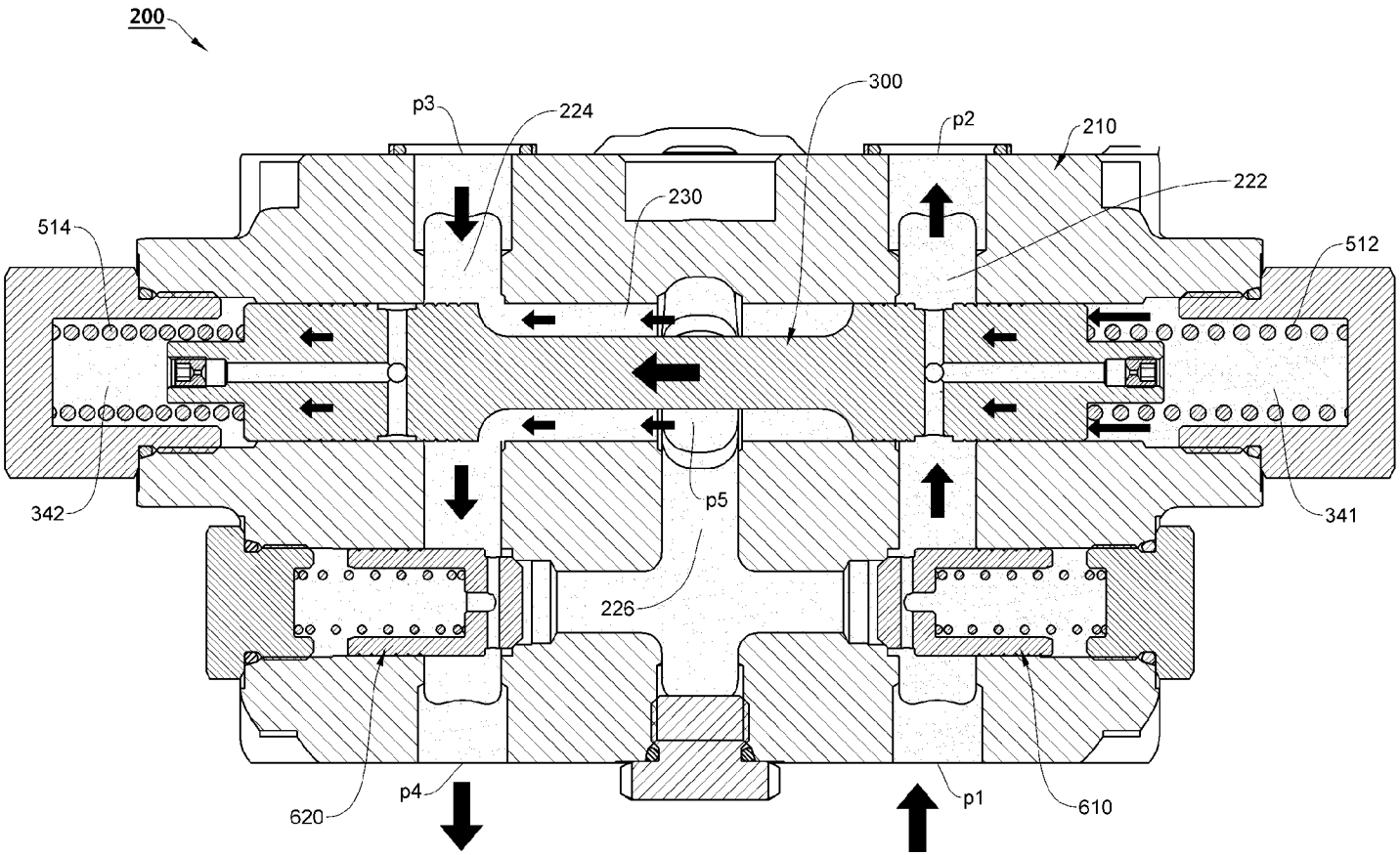
FIGS. 11 and 12 are diagrams for describing an action of the control valve unit for the hydraulic system for the construction machine according to the exemplary embodiment of the present disclosure, and are a diagram for describing an example, in which a flow rate is supplemented, and a diagram for describing a hydraulic system, respectively.
Figure 12:
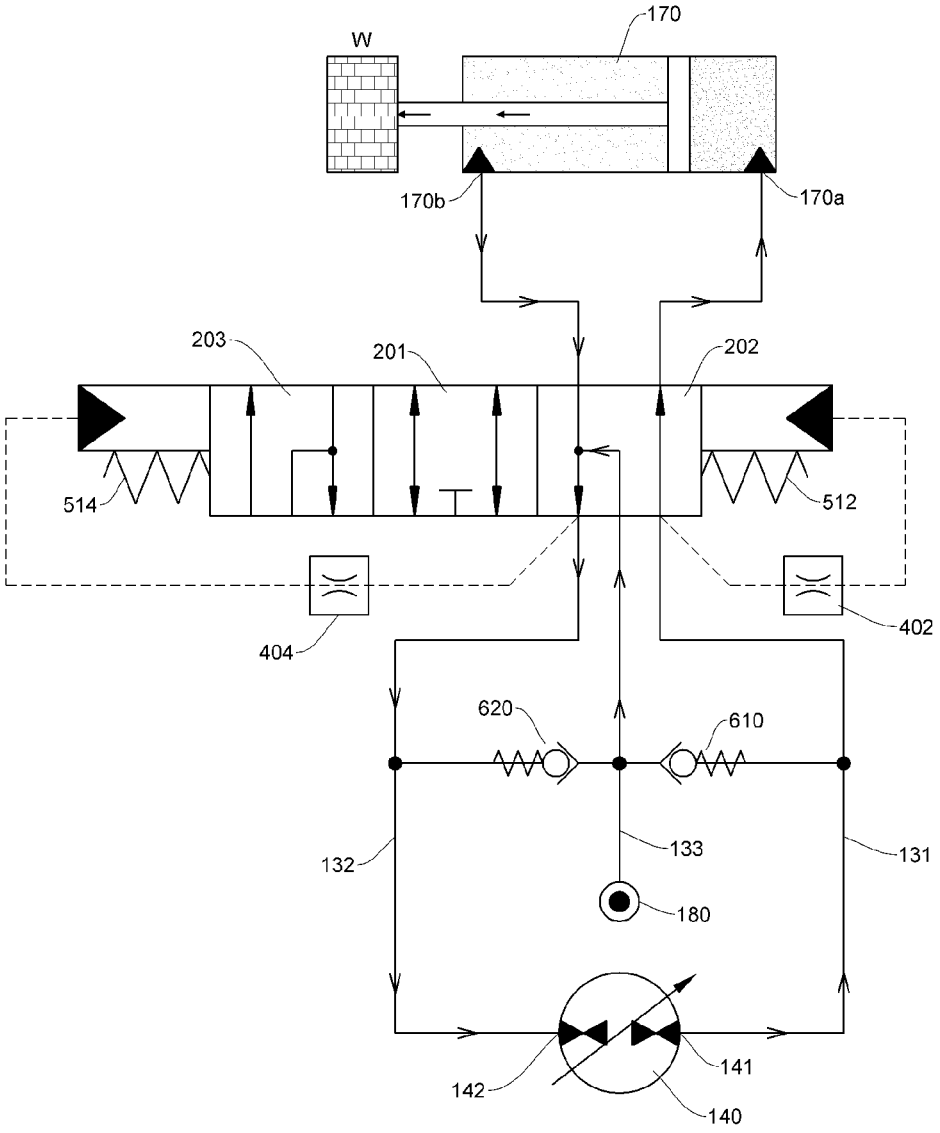

FIGS. 11 and 12 are diagrams for describing an action of the control valve unit for the hydraulic system for the construction machine according to the exemplary embodiment of the present disclosure, and are a diagram for describing an example, in which a flow rate is supplemented, and a diagram for describing a hydraulic system, respectively.

As described above, the first working oil flow rate provided to the actuator 170 is different from the second working oil flow rate discharged from the actuator 170. However, the flow rate of the working oil entering the pump/motor 140 needs to be the same as the flow rate of the working oil discharged from the pump/motor 140.

When the actuator 170 is operated in a direction, in which the rod of the actuator 170 is extended, the flow rate of the working oil entering the pump/motor 140 may be relatively insufficient. In this case, a position of the spool 300 is switched from the first position 201 to the second position 202.

The reason that the position of the spool 300 is switched from the first position 201 to the second position 202 will be described below. High pressure is formed in the first hydraulic pressure line 131 and the first valve flow path 222, and relatively low pressure is formed in the second hydraulic pressure line 132 and the second valve flow path 224. Accordingly, the first pressure of the first chamber 341 is higher than the second pressure of the second chamber 342, so that the spool 300 moves by the pressure difference between the first and second pressures.

As illustrated in FIG. 11, when the spool 300 moves to the second position 202, the second valve flow path 224 is connected with the third valve flow path 226. Then, the working oil is supplemented in the second valve flow path 224 from the accumulator 180.

In the meantime, in the first check valve unit 610, the first poppet 662 maintains a closed state by the high pressure. Further, the second check valve unit 620 maintains a closed state by restoration force of the second poppet spring 634.

Figure 13:
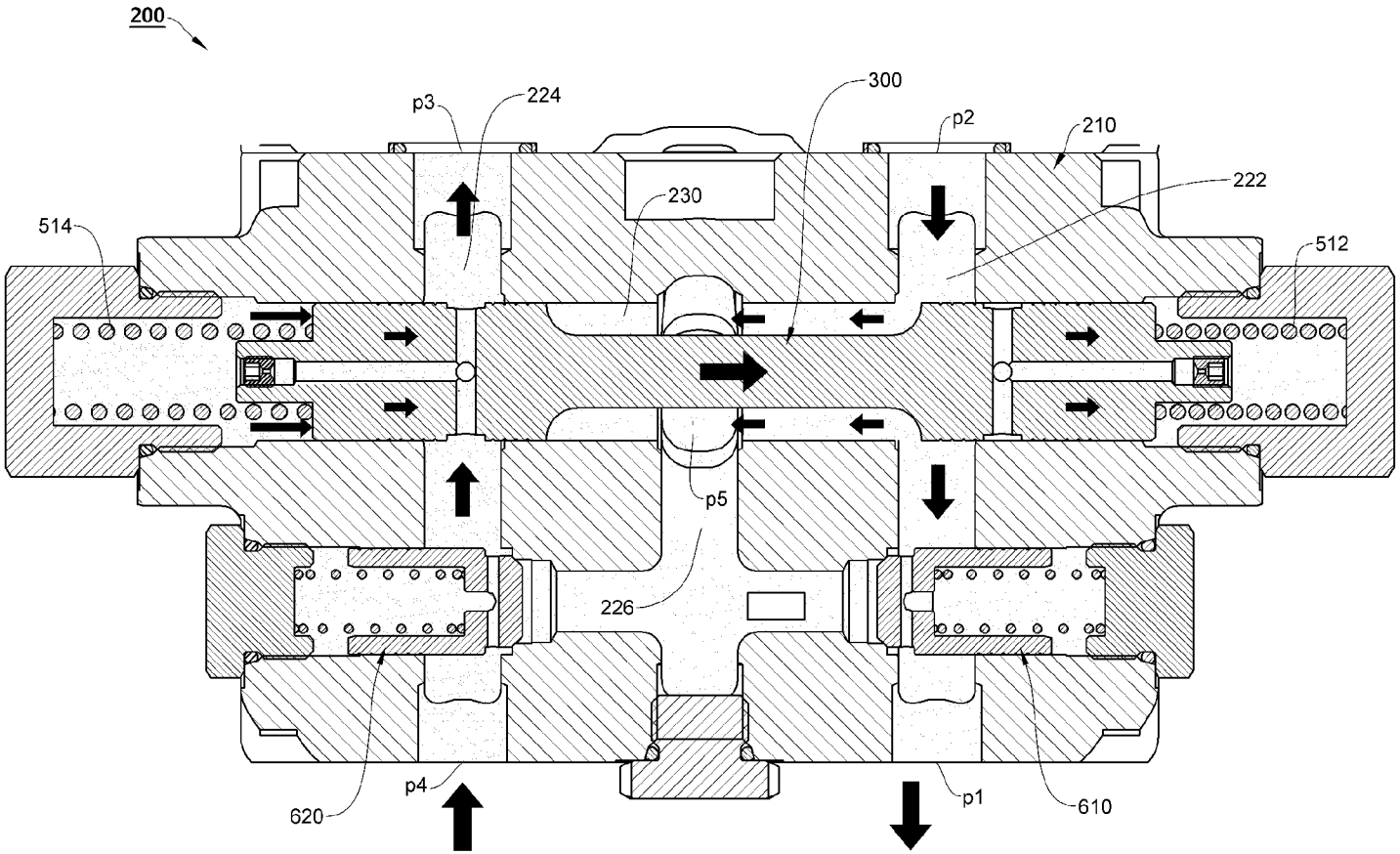
FIG. 13 is a diagram for describing an action of the control valve unit for the hydraulic system for the construction machine according to the exemplary embodiment of the present disclosure, and is a diagram for describing an example, in which a flow rate is discharged.

FIG. 13 is a diagram for describing an action of the control valve unit for the hydraulic system for the construction machine according to the exemplary embodiment of the present disclosure, and is a diagram for describing an example, in which a flow rate is discharged.

When the actuator 170 is operated in a direction, in which the rod of the actuator 170 is extended, the flow rate of the working oil returned to the pump/motor 140 may be relatively excessive. In this case, a position of the spool 300 is switched from the first position 201 to the third position 203.

The reason that the position of the spool 300 is switched from the first position 201 to the third position 203 will be described below. High pressure is formed in the second hydraulic pressure line 132 and the second valve flow path 224, and relatively low pressure is formed in the first hydraulic pressure line 131 and the first valve flow path 222. Accordingly, the second pressure of the second chamber 344 is higher than the first pressure of the first chamber 341, so that the spool 300 moves by the pressure difference between the first and second pressures.

As illustrated in FIG. 13, when the spool 300 moves to the third position 203, the first valve flow path 222 is connected with the third valve flow path 226. Then, the working oil is discharged from the first valve flow path 222 to the accumulator 180 and stored in the accumulator 180.

In the meantime, the first check valve unit 610 maintains a closed state by restoration force of the first poppet spring 632. Further, in the second check valve unit 620, the second poppet 624 maintains a closed state by the high pressure.

Figure 14:
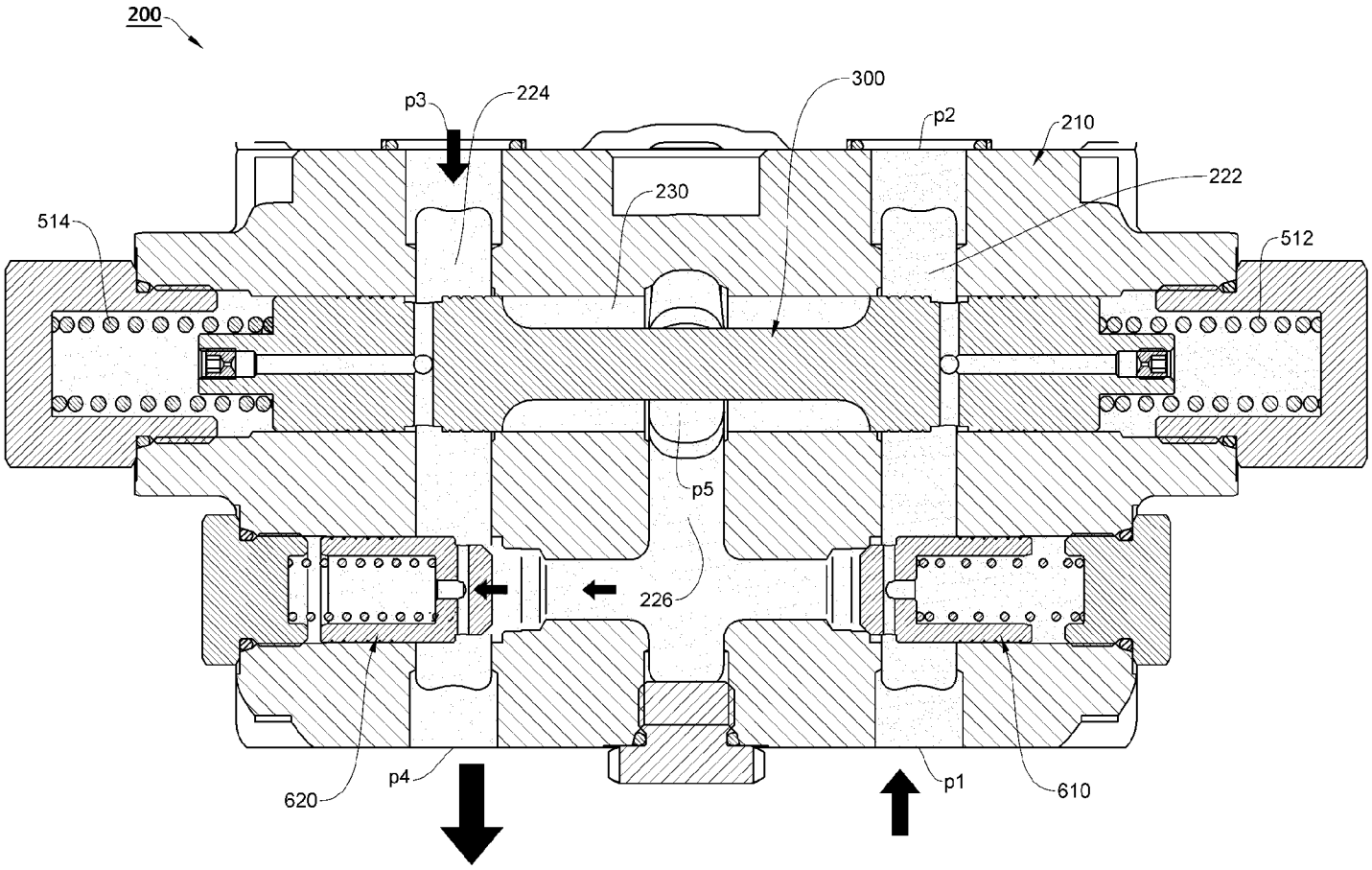
FIG. 14 is a diagram for describing an action of the control valve unit for the hydraulic system for the construction machine according to the exemplary embodiment of the present disclosure, and is a diagram for describing an example, in which pressure balance is maintained.

FIG. 14 is a diagram for describing an action of the control valve unit for the hydraulic system for the construction machine according to the exemplary embodiment of the present disclosure, and is a diagram for describing an example, in which pressure balance is maintained.

Abnormal low pressure may be generated in the first and second hydraulic pressure line 131 and 132 or the first and second valve flow paths 222 and 224. As an example, in which low pressure is generated, in a state where the rod of the actuator 170 does not move, the pump/motor 140 may continuously move by inertia. For example, when the pump/motor 140 is operated and sucks the working oil at a side connected with the fourth valve port p4, the second pressure may be decreased in the second valve flow path 224.

As another example, in which low pressure is generated, the pump/motor 140 is not operated, but the actuator 170 may be expanded or contracted by a load W. More specifically, when the actuator 170 is a boom cylinder, the load w is applied in the direction, in which the rod is contracted, so that negative pressure may be formed at the rod side of the actuator 170. In the meantime, when the actuator 170 is an arm cylinder, the load w is applied in the direction, in which the rod is expanded, so that negative pressure may be formed at the head side of the actuator 170.

Further, in the hydraulic system, negative pressure may be formed in a specific hydraulic pressure line by an unknown reason.

Next, an opening of the check valve unit will be described. When the second pressure is lower than the third pressure of the accumulator 180, the second check valve unit 620 is opened. Through the opening of the second check valve unit 620, the working oil of the accumulator 180 is supplemented in the second valve flow path 224.

On the other hand, the working oil is supplemented in the first and second valve flow paths 222 and 224 by a change in the position of the spool 300 or the opening of the first and second check valve units 610 and 620. However, in the control valve unit 200 according to the exemplary embodiment of the present disclosure, a movement of the spool 300 has priority by the pressure difference between the pressure formed in the first and second valve flow paths 222 and 224, so that it is possible to rapidly resolve the pressure difference by abnormal negative pressure within the control valve unit 220, and thus any one of the first and second check valve units 610 and 620 always and essentially maintains a closed state.

Accordingly, the hydraulic system according to the exemplary embodiment of the present disclosure may solve a problem of the hydraulic system in the related art in that the first and second check valve units 51 and 52 are simultaneously opened.

In the control valve unit for the hydraulic system for the construction machine according to the present disclosure, which is configured as described above, the pressures of the first and second valve flow paths 222 and 224 compete with each other at both sides of the spool 300, and the spool 300 moves to a side having lower pressure. Accordingly, the flow path having lower pressure between the first and second valve flow paths 222 and 224 is connected with the third valve flow path 226 to be supplemented with the working oil, and a flow path having the higher pressure discharges the flow rate to the accumulator. That is, even though pressure lower than the pressure of the accumulator is formed in both the first and second hydraulic pressure lines, the spool always moves to any one side and is supplemented with the flow rate, so that the pressure of any one line between the first and second hydraulic pressure lines is balanced with the pressure of the accumulator. Accordingly, any one of the first and second check valve units 610 and 620 always maintains a closed state, and the other is opened, so that the first and second check valve units 610 and 620 are clearly operated. Further, it is possible to stably provide the working oil to the actuator 170, thereby smoothly progressing a desired operation.

The hydraulic system for the construction machine according to the present disclosure, in which an exclusive pump/motor is installed in an actuator, even when a small pressure difference is generated between inlet/outlet lines of the actuator, a flow rate of the pump is not internally circulated, but is applied to the actuator, thereby being used for maintaining an operation speed of the actuator.

Further, when a flow rate is insufficient in a hydraulic pressure line in the hydraulic system, the hydraulic system for the construction machine according to the present disclosure may be used for supplementing a flow rate in the hydraulic pressure line, and when a flow rate is excessive in a hydraulic pressure line, the hydraulic system for the construction machine according to the present disclosure may be used for discharging a flow rate from the hydraulic pressure line.

What is claimed is:

1. A hydraulic system for a construction machine, comprising:

a pump/motor configured to serve as both a hydraulic pump driven by an engine and discharging working oil and a motor generating rotational force by the working oil;

an actuator operated by receiving hydraulic pressure from the pump/motor and provided with first and second ports through which the hydraulic pressure flows in and out;

first and second hydraulic pressure lines configured to connect the pump/motor and the actuator;

an accumulator configured to store or discharge the working oil through the first and second hydraulic pressure lines and first and second bypass lines;

first and second check valve units provided on the first and second bypass lines respectively and configured to allow the working oil to move only to the first and second hydraulic pressure lines; and a control valve unit, of which both pressure receiving portions are connected with the first and second hydraulic pressure lines, and switched so that a hydraulic pressure line having lower pressure between the first and second hydraulic pressure lines communicates with the accumulator, wherein third and fourth bypass lines connecting the first and second hydraulic pressure lines and the accumulator are installed between the first and second hydraulic pressure lines and the accumulator, and the hydraulic system further comprises relief valve units, which open and close the third and fourth bypass lines so that the hydraulic pressure is supplied to the accumulator when hydraulic pressure of the first and second hydraulic pressure lines is higher than set pressure, on the third and fourth bypass lines, wherein the control valve unit comprises:

a valve block, in which a first valve flow path is formed so that a first valve port communicates with a second valve port, a second valve flow path is formed so that a third valve port communicates with a fourth valve port, a third valve flow path communicating with the accumulator is formed, a spool hole communicating with the first, second, and third valve flow paths is formed, and a check valve hole communicating with the first, second, and third valve flow paths is formed; and a spool disposed in the spool hole, and configured to make lower hydraulic pressure between the first pressure of the first valve flow path and the second pressure of the second valve flow path communicate with the third valve flow path, wherein first and second chambers are formed at both sides of the spool, and a common groove is formed in an outer peripheral area of a center of the spool so that the first valve flow path communicates with the third valve flow path or the second valve flow path communicates with the third valve flow path, a first spool hydraulic pressure line is formed so that the first valve flow path communicates with the first chamber, a second spool hydraulic pressure line is formed so that the second valve flow path communicates with the second chamber, and first and second spool orifice hydraulic pressure lines are formed in the first and second spool hydraulic pressure lines, respectively, so that the first pressure and the second pressure compete with each other at both ends of the spool, and the spool moves to a lower pressure side, wherein first and second orifice units are formed in the first and second spool orifice hydraulic pressure lines, respectively, first and second orifice holes are formed in the first and second orifice units, respectively, and response speed of the spool is determined by the first and second orifice holes, and wherein the first and second orifice units are replaced with other orifice units having different sizes of internal diameters of the first and second orifice holes, so that the response speed of the spool is adjusted.

2. The hydraulic system of claim 1, wherein the control valve unit comprises an internal flow path comprising a second position connecting the second hydraulic pressure line and the accumulator, a third position connecting the first hydraulic pressure line and the accumulator, and a first position blocking hydraulic pressure from flowing to any one side, and has a spool structure, in which a first pressure and a second pressure of the first and second hydraulic pressure lines are applied to both pressure receiving portions.

3. The hydraulic system of claim 2, wherein when the first pressure and the second pressure are within a predetermined range, the spool of the control valve unit is maintained at the first position.

4. The hydraulic system of claim 1, wherein when the first pressure is higher than the second pressure, the control valve unit is configured to be switched so that the second pressure line is connected with the accumulator, and the first pressure is applied to the actuator, when the first pressure is lower than the second pressure, the control valve unit is configured to be switched so that the first pressure line is connected with the accumulator, and the second pressure is applied to the actuator, and when the first pressure is the same as the second pressure, the control valve unit is configured to be switched so that the first and second pressure lines are blocked from the accumulator.

5. The hydraulic system of claim 1, further comprising:

a first check valve unit provided in the first valve flow path and the check valve hole and opened when the first pressure is lower than a third pressure of the third valve flow path; and a second check valve unit provided in the second valve flow path and the check valve hole and opened when the second pressure is lower than the third pressure.

6. The hydraulic system for a construction machine, comprising:

a pump/motor configured to serve as both a pump and a motor;

an actuator provided with a first port at a head side of a cylinder and a second port at a rod side of the cylinder;

an accumulator configured to store working oil;

a first hydraulic pressure line, through which the pump/motor and the first port are connected, and in which a first pressure is formed;

a second hydraulic pressure line, through which the pump/motor and the second port are connected, and in which a second pressure is formed;

first and second check valve units provided in first and second bypass lines connected with the first and second hydraulic pressure lines and the accumulator and configured to allow the working oil to move only to the first and second hydraulic pressure lines, respectively;

a plurality of relief valve units provided in third and fourth bypass lines connected with the first and second hydraulic pressure lines and the accumulator, and configured to maintain the first and second pressures to be the same as or lower than set pressure; and a control valve unit, in which the first pressure and the second pressure are applied to both sides of a spool, configured to be switched so that higher pressure is blocked from the accumulator and lower pressure is connected with the accumulator when the higher pressure is formed in any one of the first and second pressures, wherein the control valve unit comprises:

a valve block, in which a first valve flow path is formed so that a first valve port communicates with a second valve port, a second valve flow path is formed so that a third valve port communicates with a fourth valve port, a third valve flow path communicating with the accumulator is formed, a spool hole communicating with the first, second, and third valve flow paths is formed, and a check valve hole communicating with the first, second, and third valve flow paths is formed; and a spool disposed in the spool hole, and configured to make lower hydraulic pressure between the first pressure of the first valve flow path and the second pressure of the second valve flow path communicate with the third valve flow path, wherein first and second chambers are formed at both sides of the spool, and a common groove is formed in an outer peripheral area of a center of the spool so that the first valve flow path communicates with the third valve flow path or the second valve flow path communicates with the third valve flow path, a first spool hydraulic pressure line is formed so that the first valve flow path communicates with the first chamber, a second spool hydraulic pressure line is formed so that the second valve flow path communicates with the second chamber, and first and second spool orifice hydraulic pressure lines are formed in the first and second spool hydraulic pressure lines, respectively, so that the first pressure and the second pressure compete with each other at both ends of the spool, and the spool moves to a lower pressure side, wherein first and second orifice units are formed in the first and second spool orifice hydraulic pressure lines, respectively, first and second orifice holes are formed in the first and second orifice units, respectively, and response speed of the spool is determined by the first and second orifice holes, and wherein the first and second orifice units are replaced with other orifice units having different sizes of internal diameters of the first and second orifice holes, so that the response speed of the spool is adjusted.

7. The hydraulic system of claim 6, wherein the control valve unit comprises an internal flow path comprising a second position connecting the second hydraulic pressure line and the accumulator, a third position connecting the first hydraulic pressure line and the accumulator, and a first position blocking hydraulic pressure from flowing to any one side, and has a spool structure, in which a first pressure and a second pressure of the first and second hydraulic pressure lines are applied to both pressure receiving portions.

8. The hydraulic system of claim 7, wherein when the first pressure and the second pressure are within a predetermined range, the spool of the control valve unit is maintained at the first position.

9. The hydraulic system of claim 6, further comprising:

a first check valve unit provided in the first valve flow path and the check valve hole and opened when the first pressure is lower than a third pressure of the third valve flow path; and a second check valve unit provided in the second valve flow path and the check valve hole and opened when the second pressure is lower than the third pressure.

* * * * *